US008891719B2

(12) United States Patent
Howard et al.

(10) Patent No.: US 8,891,719 B2
(45) **Date of Patent: *Nov. 18, 2014**

(54) SYSTEMS AND METHODS FOR PLASMA COMPRESSION WITH RECYCLING OF PROJECTILES

(75) Inventors: Stephen James Howard, Port Moody (CA); Michel Georges Laberge, West Vancouver (CA); Lon McIlwraith, Delta (CA); Douglas Harvey Richardson, Anmore (CA); James Gregson, Vancouver (CA)

(73) Assignee: General Fusion, Inc. (CA)

( * ) Notice: Subject to any disclaimer, the term of this patent is extended or adjusted under 35 U.S.C. 154(b) by 672 days.

This patent is subject to a terminal disclaimer.

(21) Appl. No.: 12/845,071

(22) Filed: Jul. 28, 2010

(65) Prior Publication Data

US 2011/0026658 A1 Feb. 3, 2011

Related U.S. Application Data

(60) Provisional application No. 61/229,355, filed on Jul. 29, 2009.

(51) Int. Cl.

| | |
|---|---|
| ***G21B 1/15*** | (2006.01) |
| ***G21B 1/13*** | (2006.01) |
| ***H05H 1/02*** | (2006.01) |
| ***H05H 1/54*** | (2006.01) |
| ***G21B 3/00*** | (2006.01) |

(52) U.S. Cl.

CPC . *H05H 1/54* (2013.01); *H05H 1/02* (2013.01); *G21B 3/006* (2013.01)

USPC ..... 376/133; 376/149; 376/150

(58) Field of Classification Search

USPC ..... 376/133, 150

See application file for complete search history.

(56) References Cited

U.S. PATENT DOCUMENTS

| | | | |
|---|---|---|---|
| 2,939,048 | A | 5/1960 | Waniek |
| 2,953,718 | A | 9/1960 | Ducati |
| 2,991,238 | A | 7/1961 | Phillips et al. |
| 2,992,345 | A | 7/1961 | Hansen |
| 3,189,523 | A | 6/1965 | Patrick |
| 3,194,739 | A | 7/1965 | Kerst et al. |

(Continued)

FOREIGN PATENT DOCUMENTS

| | | |
|---|---|---|
| CA | 2031841 | 6/1992 |
| CA | 2104939 | 4/1995 |

(Continued)

OTHER PUBLICATIONS

Communication Pursuant to Rule 71(3) EPC, dated Jan. 9, 2013 in corresponding European Application No. 10740096.2, in 43 pages.

(Continued)

*Primary Examiner* — Jack W Keith
*Assistant Examiner* — Sean P Burke
(74) *Attorney, Agent, or Firm* — Knobbe, Martens, Olson & Bear, LLP

(57) ABSTRACT

Embodiments of systems and methods for compressing plasma are disclosed in which plasma can be compressed by impact of a projectile on a magnetized plasma in a liquid metal cavity. The projectile can melt in the liquid metal cavity, and liquid metal may be recycled to form new projectiles.

17 Claims, 6 Drawing Sheets

(56) References Cited

U.S. PATENT DOCUMENTS 3,309,967 A 3/1967 Taplin
3,313,707 A 4/1967 Amsler
3,338,788 A 8/1967 Linhart
3,346,458 A 10/1967 Scmidt
3,624,239 A 11/1971 Fraas
3,631,760 A 1/1972 Moran
3,748,226 A 7/1973 Ribe et al.
3,753,304 A 8/1973 Hughes
3,925,990 A 12/1975 Gross
3,973,468 A 8/1976 Russell, Jr.
3,983,303 A 9/1976 Biermann et al.
4,012,166 A 3/1977 Kaesser et al.
4,023,065 A 5/1977 Koloc
4,026,192 A 5/1977 Noren et al.
4,049,367 A 9/1977 Tominaga et al.
4,068,147 A 1/1978 Wells
4,129,772 A 12/1978 Navratil et al.
4,140,057 A 2/1979 Turchi et al.
4,158,598 A * 6/1979 Baird ..... 376/104
4,166,760 A 9/1979 Fowler et al.
4,182,650 A 1/1980 Fischer
4,196,788 A 4/1980 Sciard
4,207,154 A 6/1980 Lemelson
4,217,171 A 8/1980 Schaffer
4,228,380 A 10/1980 Wells
4,252,605 A 2/1981 Schaffer
4,257,798 A 3/1981 Hendricks et al.
4,263,095 A 4/1981 Thode
4,269,658 A 5/1981 Ohkawa
4,269,659 A 5/1981 Goldberg
4,277,305 A 7/1981 Bohachevsky
4,284,164 A 8/1981 Airhart
4,290,848 A 9/1981 Sudan
4,292,126 A 9/1981 Ohkawa
4,292,568 A 9/1981 Wells et al.
4,304,627 A 12/1981 Lewis
4,305,784 A 12/1981 Ohkawa
4,328,070 A 5/1982 Winterberg
4,333,796 A 6/1982 Flynn
4,342,720 A 8/1982 Wells
4,363,775 A 12/1982 Bussard et al.
4,367,130 A 1/1983 Lemelson
4,385,880 A 5/1983 Lemelson
4,390,322 A 6/1983 Budzich
4,435,354 A 3/1984 Winterberg
4,449,892 A 5/1984 Bentley
4,454,850 A 6/1984 Horvath
4,534,263 A 8/1985 Heyne et al.
4,563,341 A 1/1986 Flynn
4,625,681 A 12/1986 Sutekiyo
4,643,854 A 2/1987 Kendall, Jr. et al.
4,687,045 A 8/1987 Roller
4,735,762 A 4/1988 Lasche
4,761,118 A 8/1988 Zanarini
4,790,735 A 12/1988 Mayer
4,930,355 A 6/1990 Heck
5,015,432 A 5/1991 Koloc
5,041,760 A 8/1991 Koloc
5,087,435 A 2/1992 Potter et al.
5,114,261 A 5/1992 Sugimoto et al.
5,160,695 A 11/1992 Bussard
5,227,239 A 7/1993 Upadhye et al.
5,305,091 A 4/1994 Gelbart et al.
5,397,961 A 3/1995 Ayers et al.
5,429,030 A 7/1995 Tidman
5,430,776 A 7/1995 Stauffer et al.
5,526,885 A 6/1996 Kuvshinov et al.
5,659,173 A 8/1997 Putterman et al.
5,811,944 A 9/1998 Sampayan et al.
5,818,498 A 10/1998 Richardson et al.
5,821,705 A 10/1998 Sampayan et al.
5,858,104 A 1/1999 Clark
5,920,394 A 7/1999 Gelbart et al.
5,968,323 A 10/1999 Pless
6,141,395 A 10/2000 Nishimura et al.
6,181,362 B1 1/2001 Laberge
6,235,067 B1 5/2001 Ahern et al.
6,252,622 B1 6/2001 Laberge
6,377,739 B1 4/2002 Richardson
6,396,213 B1 5/2002 Koloc
6,408,052 B1 6/2002 McGeoch
6,411,666 B1 6/2002 Woolley
6,418,177 B1 7/2002 Stauffer et al.
6,477,216 B2 11/2002 Koloc
6,532,887 B1 3/2003 Venier et al.
6,587,211 B1 7/2003 Gelbart
6,593,539 B1 7/2003 Miley et al.
6,611,106 B2 8/2003 Monkhorst et al.
6,628,740 B2 9/2003 Monkhorst et al.
6,654,433 B1 11/2003 Boscoli
6,660,997 B2 12/2003 Laberge et al.
6,664,740 B2 12/2003 Rostoker et al.
6,665,048 B2 12/2003 Gelbart
6,680,480 B2 1/2004 Schoen
6,729,277 B2 5/2004 Yamaki et al.
6,763,160 B2 7/2004 Laberge et al.
6,784,591 B2 8/2004 Baker, Jr.
6,832,552 B2 12/2004 Patten et al.
6,837,145 B1 1/2005 McBride et al.
6,842,553 B2 1/2005 Richardson
6,850,011 B2 2/2005 Monkhorst et al.
6,852,942 B2 2/2005 Monkhorst et al.
6,870,894 B2 3/2005 Lou et al.
6,888,434 B2 5/2005 Nordberg
6,888,907 B2 5/2005 Monkhorst et al.
6,891,911 B2 5/2005 Rostoker et al.
6,894,446 B2 5/2005 Monkhorst et al.
6,941,035 B2 9/2005 Laberge et al.
6,995,515 B2 2/2006 Rostoker et al.
7,002,148 B2 2/2006 Monkhorst et al.
7,015,646 B2 3/2006 Rostoker et al.
7,026,763 B2 4/2006 Rostoker et al.
7,079,001 B2 7/2006 Nordberg
7,119,491 B2 10/2006 Rostoker et al.
7,126,284 B2 10/2006 Rostoker et al.
7,129,656 B2 10/2006 Rostoker et al.
7,173,385 B2 2/2007 Caporaso et al.
7,180,082 B1 2/2007 Hassanein et al.
7,180,242 B2 2/2007 Rostoker et al.
7,230,201 B1 6/2007 Miley et al.
7,232,985 B2 6/2007 Monkhorst et al.
7,260,462 B2 8/2007 Keim et al.
7,372,059 B2 5/2008 Shumlak et al.
7,391,160 B2 6/2008 Monkhorst et al.
7,439,678 B2 10/2008 Rostoker et al.
7,459,654 B2 12/2008 Monkhorst et al.
7,477,718 B2 1/2009 Rostoker et al.
7,482,607 B2 1/2009 Lerner et al.
7,486,758 B1 2/2009 Turchi
7,501,640 B2 3/2009 Larson
7,550,741 B2 6/2009 Sanns
7,569,995 B2 8/2009 Rostoker et al.
7,576,499 B2 8/2009 Caporaso et al.
7,613,271 B2 11/2009 Rostoker et al.
7,619,232 B2 11/2009 Schmidt et al.
7,679,025 B1 3/2010 Krishnan et al.
7,679,027 B2 3/2010 Bogatu
7,719,199 B2 5/2010 Monkhorst et al.
7,825,391 B2 11/2010 Shumlak et al.
7,831,008 B2 11/2010 Perkins et al.
7,973,296 B2 7/2011 Quick
8,031,824 B2 10/2011 Bystriskii et al.
8,059,779 B2 11/2011 Greatbatch
8,090,071 B2 1/2012 DeLuze
8,139,287 B2 3/2012 Winterberg
8,279,994 B2 10/2012 Kotschenreuther et al.
8,537,958 B2 9/2013 Laberge et al.
2002/0057754 A1 5/2002 Stauffer et al.
2002/0090047 A1 7/2002 Stringham
2003/0074010 A1 4/2003 Taleyarkhan
2003/0215046 A1 11/2003 Hornkohl
2004/0141578 A1 7/2004 Enfinger
2005/0129161 A1 6/2005 Laberge
2005/0271181 A1 12/2005 Winterberg

(56) References Cited

U.S. PATENT DOCUMENTS

| | | | |
|---|---|---|---|
| 2006/0039519 | A1 | 2/2006 | Rostoker et al. |
| 2006/0076897 | A1 | 4/2006 | Rostoker et al. |
| 2006/0198483 | A1 | 9/2006 | Laberge |
| 2006/0198486 | A1 | 9/2006 | Laberge et al. |
| 2006/0198487 | A1 | 9/2006 | Laberge |
| 2006/0254520 | A1 | 11/2006 | Rostoker |
| 2006/0267504 | A1 | 11/2006 | VanDrie et al. |
| 2007/0058770 | A1 | 3/2007 | Fissenko et al. |
| 2007/0096659 | A1 | 5/2007 | Monkhorst et al. |
| 2007/0158534 | A1 | 7/2007 | Monkhorst et al. |
| 2007/0172017 | A1 | 7/2007 | Rostoker et al. |
| 2007/0211841 | A1 | 9/2007 | Tomory |
| 2008/0008286 | A1 | 1/2008 | Jacobson |
| 2008/0063132 | A1 | 3/2008 | Birnbach |
| 2008/0187086 | A1 | 8/2008 | Bussard |
| 2008/0205573 | A1 | 8/2008 | Larson |
| 2009/0059718 | A1 | 3/2009 | Tessien |
| 2009/0152094 | A1 | 6/2009 | Fissenko et al. |
| 2009/0213975 | A1 | 8/2009 | Sturt |
| 2009/0213976 | A1 | 8/2009 | Gioscia et al. |
| 2009/0290673 | A1 | 11/2009 | Svidzinski |
| 2009/0310731 | A1 | 12/2009 | Burke et al. |
| 2010/0066252 | A1 | 3/2010 | Reijonen et al. |
| 2010/0067639 | A1 | 3/2010 | Sturt |
| 2010/0104058 | A1 | 4/2010 | Birnbach |
| 2010/0150291 | A1 | 6/2010 | Jung et al. |
| 2010/0163130 | A1 | 7/2010 | Laberge et al. |
| 2010/0202580 | A1 | 8/2010 | Wurden et al. |
| 2010/0215136 | A1 | 8/2010 | Rusnak et al. |
| 2010/0284501 | A1 | 11/2010 | Rogers |
| 2010/0329407 | A1 | 12/2010 | Kotschenreuther et al. |
| 2011/0007860 | A1 | 1/2011 | Sanders, Jr. |
| 2011/0019789 | A1 | 1/2011 | Wessel et al. |
| 2011/0026657 | A1 | 2/2011 | Laberge et al. |
| 2011/0044416 | A1 | 2/2011 | Cabellero et al. |
| 2011/0064179 | A1 | 3/2011 | Birnbach |
| 2011/0075783 | A1 | 3/2011 | Mcgervey et al. |
| 2011/0085632 | A1 | 4/2011 | Klein et al. |
| 2011/0091004 | A1 | 4/2011 | Farmer et al. |
| 2011/0142185 | A1 | 6/2011 | Woodruff |
| 2011/0158369 | A1 | 6/2011 | Larson |
| 2011/0170647 | A1 | 7/2011 | Bussard |
| 2011/0188622 | A1 | 8/2011 | Shrier |
| 2011/0200153 | A1 | 8/2011 | Ferreira, Jr. |
| 2011/0216866 | A1 | 9/2011 | Pearson |
| 2011/0243292 | A1 | 10/2011 | Howard et al. |
| 2011/0253682 | A1 | 10/2011 | Gutman |
| 2011/0261918 | A1 | 10/2011 | Schmidt |
| 2011/0261919 | A1 | 10/2011 | Sefcik et al. |
| 2011/0274228 | A1 | 11/2011 | Lopez |
| 2011/0286563 | A1 | 11/2011 | Moses et al. |
| 2011/0286570 | A1 | 11/2011 | Farmer et al. |
| 2011/0293056 | A1 | 12/2011 | Slough |
| 2012/0002773 | A1 | 1/2012 | Hunter, Jr. et al. |
| 2012/0008728 | A1 | 1/2012 | Fleming |
| 2012/0014491 | A1 | 1/2012 | Deeth |
| 2012/0031070 | A1 | 2/2012 | Slough et al. |
| 2012/0033775 | A1 | 2/2012 | Santilli |
| 2012/0039431 | A1 | 2/2012 | Schmidt |
| 2012/0057665 | A1 | 3/2012 | Moses et al. |
| 2012/0076253 | A1 | 3/2012 | Howard, Jr. |
| 2012/0085920 | A1 | 4/2012 | Guethlein |
| 2012/0086364 | A1 | 4/2012 | Guethlein |
| 2012/0114088 | A1 | 5/2012 | Amendt et al. |
| 2012/0152722 | A1 | 6/2012 | Birnbach et al. |
| 2012/0155591 | A1 | 6/2012 | Freeze |
| 2014/0165552 | A1 | 6/2014 | McIlwraith et al. |

FOREIGN PATENT DOCUMENTS

| | | | |
|---|---|---|---|
| CA | 2124364 | | 11/1995 |
| CA | 2262581 | | 2/1998 |
| CA | 2477960 | | 2/2004 |
| CA | 2750441 | | 4/2012 |
| CH | 607236 | | 11/1978 |
| DE | 2516296 | | 10/1975 |
| EP | 0662693 | | 5/1994 |
| EP | 2460160 | B1 | 6/2013 |
| GB | 774052 | | 6/1954 |
| GB | 825026 | | 12/1959 |
| JP | S38-001269 | | 2/1963 |
| JP | S55-501066 | | 12/1980 |
| JP | S59-090078 | | 5/1984 |
| JP | 61-116683 | | 6/1986 |
| JP | 03067196 | A | 3/1991 |
| JP | 03226694 | A | 10/1991 |
| JP | 06317684 | A | 11/1994 |
| JP | H06-511518 | | 12/1994 |
| JP | H07-174876 | | 7/1995 |
| JP | H07-201497 | | 8/1995 |
| JP | H09-189786 | | 7/1997 |
| JP | H11-144890 | | 5/1999 |
| JP | 2004-335479 | | 11/2004 |
| JP | 2006-310101 | | 11/2006 |
| WO | WO 80/00045 | | 1/1980 |
| WO | WO 90/13129 | | 11/1990 |
| WO | WO 90/13136 | | 11/1990 |
| WO | WO 90/14670 | | 11/1990 |
| WO | WO 91/10242 | | 7/1991 |
| WO | WO 91/13531 | | 9/1991 |
| WO | WO 93/23587 | | 11/1993 |
| WO | WO 94/16446 | | 7/1994 |
| WO | WO 95/03611 | | 2/1995 |
| WO | WO 95/16995 | | 6/1995 |
| WO | WO 96/21230 | | 7/1996 |
| WO | WO 96/36969 | | 11/1996 |
| WO | WO 97/49274 | | 12/1997 |
| WO | WO 99/56284 | | 11/1999 |
| WO | WO 01/39197 | | 5/2001 |
| WO | WO 01/39198 | A2 | 5/2001 |
| WO | WO 01/39199 | A2 | 5/2001 |
| WO | WO 01/39200 | A2 | 5/2001 |
| WO | WO 01/39201 | A2 | 5/2001 |
| WO | WO 01/39202 | A2 | 5/2001 |
| WO | WO 01/39203 | A2 | 5/2001 |
| WO | WO 01/39204 | A2 | 5/2001 |
| WO | WO 01/39205 | A2 | 5/2001 |
| WO | WO 01/39206 | A2 | 5/2001 |
| WO | WO 02/05292 | | 1/2002 |
| WO | WO 02/097823 | | 12/2002 |
| WO | WO 03/034441 | | 4/2003 |
| WO | WO 03/077260 | | 9/2003 |
| WO | WO 2010/114360 | A1 | 10/2010 |
| WO | WO 2011/014577 | | 2/2011 |
| WO | WO 2011/084903 | A1 | 7/2011 |
| WO | WO 2011/154172 | A1 | 12/2011 |
| WO | WO 2011/154717 | A1 | 12/2011 |
| WO | WO 2012/037488 | A1 | 3/2012 |
| WO | WO 2012/064746 | A1 | 5/2012 |
| WO | WO 2012/064767 | A1 | 5/2012 |
| WO | WO 2012/064773 | A1 | 5/2012 |
| WO | WO 2012/103548 | A1 | 8/2012 |
| WO | WO 2012/113057 | A1 | 8/2012 |

OTHER PUBLICATIONS

Dec. 12, 2011 Notice of Abandonment in U.S. Appl. No. 13/161,852 in 2 pages.

D. Foley, "Star in a Jar", Popular Science, Dec. 1998.

D.N. Hill et al., "Field and Current Amplification in the SSPX Spheromak," 19th IAEA Fusion Energy Conference, Oct. 8, 2002, in 8 pages.

Fortov, V., "Nonideal plasma under extreme conditions generated by shock waves", Plasma Phys. Control, 2003, vol. Fusion, Issue 45, pp. A1-A6.

Howard, S. et al., "Development of merged compact toroids for use as a magnetized target fusion plasma," Journal of Fusion Energy, Nov. 11, 2008, vol. 28, No. 2, pp. 156-161, available Jun. 2008.

Hsu, S.C. et al., "On the Jets, Kinks, and Spheromaks Formed by a Planar Magnetized Coaxial Gun", California Institute of Technology, Pasadena, CA 91125, Feb. 2, 2008, pp. 1-16.

I. Sample, "Science runs into trouble with bubbles", The Guardian, Mar. 21, 2004.

(56) References Cited

OTHER PUBLICATIONS

International Search Report and Written Opinion mailed Jun. 23, 2009 for Int'l Application No. PCT/IB2010/000368.
International Search Report and Written Opinion mailed Nov. 30, 2010 for Int'l Application No. PCT/US2010/043587.
Intrator, T. et al., "A high density field reversed configuration (FRC) target for magnetized target fusion: First internal profile measurements of a high density FRC," Phys. Plasmas, vol. 11, No. 5, pp. 2580-2585, May 2004.
J. H. Degnan,et al, "Compression of compact toroids in conical-coaxial geometry", Fusion Technology, Mar. 1995, vol. 27, Issue 2, pp. 107-114.
J. H. Degnan,et al., "Compact toroid formation, compression, and acceleration", Phys. Fluids B, Aug. 1993, vol. 5 , Issue (8), pp. 2938-2958.
J. H. Hammer, et al, "Experimental demonstration of acceleration and focusing of magnetically confined plasma rings", Physical Review Letters, Dec. 19, 1988, vol. 61, Issue 25, pp. 2843-2846.
J. Wilson, "Hot Sounds", http://www. popularmechan ic.com/science/research/12816666.html, Feb. 1, 1998.
J.D. Lawson, "Some Criteria for a Power Producing Thermonuclear Reactor", Proc. Phys. Soc, 1957, Issue B70, pp. 6-10.
K. Suslick, "Chemistry cast doubt on bubble fusion", Nuclear News, Sep. 2002.
Kirkpatrick, R.C., "Assessment of the Acoustically Driven MTF Experiments being conducted by Dr. Michel Laberge of General Fusion, Inc.," in 3 pages, May 2007.
Knief, Nuclear Engineering, Hemisphere Publishing Corp., pp. 640-643.
L. Bertolini, et al, "SHARP, a first step towards a full sized Jules Verne Launcher", Lawrence Livermore National Lab; OSTI ID: 10125664; Legacy ID: DE94007029 Report No. UCRL-JC—114041; CONF-9305233-2, May 1, 1993, Issue CONF-9305233-2.
L. Crum, "Sonoluminescence and Acoustic Inertial Confinement", Fifth International Symposium on Cavitation, Nov. 1-4, 2003, Osaka , Japan.
L.A., Artsimovich, "Controlled Thermonuclear Reactions", Gordon & Breach, 1964, pp. 1-4, New York , USA.
Laberge, M., "Acoustic Wave Driven MTF Fusion Reactor," in 20 pages, Mar. 2007.
Laberge, M., "An Acoustically Driven Magnetized Target Fusion Reactor," Journal of Fusion Energy, vol. 27, Nos. 1-2, pp. 65-68, Jul. 11, 2007.
Laberge, M., "Evidence of Fusion Products in Acoustically Driven MTF," in 41 pages, Mar. 2007.
Laberge, M., "Experimental Results for an Acoustic Driver for MTF," Journal of Fusion Energy, Jun. 2009, vol. 28, Nos. 2, pp. 179-182, available Jun. 2008.
Liu, D. et al., "Bench Test and Preliminary Results of Vertical Compact Torus Injection Experiments on the STOR-M Tokamak", Nuclear Fusion 46 (006) pp. 104-109, Dec. 16, 2005.
Miyazawa, J. et al., "Design of Spheromak Injector Using Conical Accelerator for Large Helical Device", Fusion Engineering and Design 54 (2001), pp. 1-12.
Moss et al, "Hydrodynamic Simulations of Bubble Collapse and Picosecond Sonoluminescence", The Physics of Fluid, 1994, vol. 6 , Issue 9, pp. 2979-2985.
Olynyk, G. et al., "Development of a Compact Toroid Fuelling System for ITER", Nuclear Fusion, vol. 48, No. 9, Sep. 2008.
Olynyk, G. M., "Design and evaluation of a repetitive-fire compact toroid fuelling system for ITER," thesis submitted to the Department of Physics, Queen's University, Ontario, Canada, Mar. 2007, in 48 pages.
R. E. Peterkin, Jr. "Direct electromagnetic acceleration of a compact toroid to high density and high speed", Physical Review Letters, Apr. 17, 1995, vol. 74, Issue 16, pp. 3165-3168.
R. L. Miller and R. A. Krakowski, "Assessment of the slowly-imploding liner (LINUS) fusion reactor concept", Los Alamos Scientific Laboratory, Oct. 1980, Issue Rept. No. LA-UR-80-3, Los Alamos, NM, USA.
R. Siemon, et al., "The Relevance of Magnetized Target Fusion (MTF) to practical energy production", A white paper for consideration by the fusion community and the Fusion Energy Scientific Advisory Committee, Jun. 3, 1999, vol. Draft 2.
R. W. Moir et al., "HYLIFE-II: An approach to a long-lived, first-wall component for inertial fusion power plants", Lawrence Livermore National Lab, Aug. 1, 1994, vol. Report No. UCRL-J, Issue CONF-940933-46.
R.C. Duck et al., "Structure of the n = 1 responsible for relaxation and current drive during sustainment of the SPHEX spheromak", Plasma Physics and Controlled Fusion, vol. 39, No. 5, May 1997.
Raman, R. et al., "Compact Toroid Fuelling for ITER", Fusion Engineering and Design 39-40 (1998), pp. 977-985.
Raman, R. et al., "Experimental Demonstration of Nondisruptive, Central Fueling of a Tokamak by Compact Toroid Injection," Phys. Rev. Lett., 1994.
Raman, R. et al., "Experimental Demonstration of Tokamak Fueling by Compact Toroid Injection," Nuclear Fusion, vol. 37, 1997.
Raman, R. et al., "ITER Task D315 (1997): Conceptual Design Definition of a Compact Toroid Injection System", CFFTP G-9729, in 24 pages, Sep. 1997.
Raman, Roger et al., "Design of the Compact Toroid Fueler for Center Fueling Tokamak de Varennes", Fusion Technology, A Journal of the American Nuclear Society, vol. 24, No. 3, Nov. 1993.
S. Putterman, "Sonoluminescence: Sound into Light", Scientific American, Feb. 1995, pp. 45-51.
Siemon, R.E. et al., "Why Magnetized Target Fusion Offers a Low-Cost Development Path for Fusion Energy," in 49 pages, Dec. 1997.
Taleyarkhan et al, "Evidence for Nuclear Emissions During Acoustic Cavitation", Science, Mar. 8, 2002, vol. 295.
Thio, Y.C.F., et al., "Magnetized Target Fusion Driven by Plasma Liners", 2002, in 3 pages.
Thomas W. Kornack, "Magnetic Reconnection Studies on SSX", Swarthmore College Department of Physics and Astronomy, Jun. 10, 1998, pp. 2-56, Swarthmore, PA, USA.
Tobin, M. T., et al., "The Compact Torus Accelerator, A Driver for ICF," UCRL-93901-R1, Lawrence Livermore National Laboratory, Jul. 31, 1986, in 9 pages.
Wurden, G.A. et al., "FRC Plasma Studies on the FRX-L Plasma Injector for MTF", Paper IC/P6-53, 20th IAEA Fusion Energy Conference, Nov. 2004, in 7 pages.
Wurden, G.A. et al., "High Pressure Field Reversed Configuration Plasmas in FRX-L for Magnetized Target Fusion", in 2 pages, Jan. 26, 2006.
Wurden, G.A. et al., "Magnetized Target Fusion: A Burning FRC Plasma in an Imploded Metal Can," J. Plasma Fusion Res. Series, vol. 2, pp. 238-241, Aug. 1999.
Wurden, G.A. et al., "Progress on the FRX-L FRC Plasma Injector at LANL for Magnetized Target Fusion", pp. 1-6, Mar. 1, 2002.
Wurden, G.A., Letter to Dr. Laberge, in 1 page, May 2007.
Xiao, C. et al., "Improved Confinement Induced by Tangential Injection of Compact Torus Into the Saskatchewan Torus-Modified (STOR-M) Tokamak," Phys. Plasmas, vol. 11, 2004.
U.S. Appl. No. 13/161,852, filed Jun. 16, 2011, titled "Systems and Methods for Plasma Compression With Recycling of Projectiles", 37 pages.
B. E. Mcdonald, "Modeling nonlinear compressional waves in marine sediments", Nonlin. Processes Geophys., vol. 16, Feb. 26, 2009, pp. 151-157.
CH. Mangeant et al., "Syrinx Project: Compact Pulse-Current Generators Devoted to Material Study Under Isentropic Compression Loading", in Pulsed Power Plasma Science, IEEE, Jun. 2001, in 4 pages.
CH. Seife, "Sun in a Bottle", Chapter 10, pp. 220-227, Penguin Books Ltd., London, UK (2008).
D. Orlikowski et al., "New experimental capabilities and theoretical insights of high pressure compression waves", Lawrence Livermore National Laboratory, UCRL-PROC-233023, Jul. 24, 2007, 10 pages.
D.J. Meeker et al., "A High Efficiency I.C.F. Driver Employing Magnetically Confined Plasma Rings", UCRL-91693 Preprint, Lawrence Livermore National Laboratory, Mar. 4, 1985, in 8 pages.

(56) References Cited

OTHER PUBLICATIONS

Gregory H. Miller et al., "The Equation of State of a Molten Komatiite 1. Shock Wave Compression to 36 GPa", Journal of Geophysical Research, vol. 96, No. B7, Jul. 10, 1991, pp. 11,831-11,848.
Hitoshi Takeuchi et al., "Equations of State of Matter from Shock Wave Experiments", Journal of Geophysical Research, vol. 71, No. 16, Aug. 15, 1966, pp. 3985-3994.
International Preliminary Report on Patentability dated Jan. 31, 2012 for Int'l Application No. PCT/US2010/043587, in 8 pages.
J. Nguyen et al., "Specifically Prescribed Dynamic Thermodynamic Paths and Resolidification Experiments", Lawrence Livermore National Laboratory, UCRL-JRNL-201169, Nov. 25, 2003, in 8 pages.
R. S. Hawke, "Design and Analysis of Isentropic Compression Experiments", Lawrence Livermore Laboratory, Preprint UCRL-81797, May 7, 1979, in 23 pages.
R.G. Kraus et al., "Equation of state of ductile granular materials", DYMAT International Conference on Mechanical and Physical Behaviour of Materials, Sep. 2009, pp. 1317-1323.
Robert S. Hixson et al., "Shock Compression Techniques for Developing Multiphase Equations of State", Los Alamos Science, No. 28, Jan. 2003, pp. 114-119.
Schaffer, M.J., "Slow Liner Fusion," General Atomics Report GA-A22689, Aug. 1997, in 6 pages.
Thomas S. Duffy et al., "Compressional sound velocity, equation of state, and constitutive response of shock-compressed magnesium oxide", Journal of Geophysical Research, vol. 100, No. B1, pp. 529-542, Jan. 10, 1995.
V.V. Prut et al., "Metallic Z-pinch method: the isentropic compression of hydrogen", JETP Lett. vol. 29, No. 1, Jan. 5, 1979, pp. 30-33.
W. J. Nellis et al., "Equation of state of shock-compressed liquids: Carbon dioxide and air", American Institute of Physics, J. Chem. Phys., vol. 95 (7), Oct. 1, 1991, pp. 5268-5272.
Y. Mizuno et al., "A Rectangular Pulse Vertical Field Circuit for a Small Tokamak", Electrical Engineering in Japan, vol. 133, No. 4, 2000, Translated from Denki Gakkai Ronbunshi, vol. 119-A, No. 12, Dec. 1999, pp. 1390-1396.
Jul. 13, 2011 Request for Participation in the Patent Cooperation Treaty-Patent Prosecution Highway (PCT-PPH) Pilot Program Between the European Patent Office (EPO) and the USPTO in U.S. Appl. No. 13/161,852, filed Jun. 16, 2011 in 21 pages.
Aug. 30, 2011 Decision on Request to Participate in Patent Prosecution Highway Program and Petition to Make Special Under 37 C.F.R. 1.102(a) in U.S. Appl. No. 13/161,852, filed Jun. 16, 2011 in 3 pages.
Sep. 29, 2011 Office Action in U.S. Appl. No. 13/161,852, filed Jun. 16, 2011 in 29 pages.
Dec. 7, 2011 Written Declaration of Abandonment Pursuant to 37 C.F.R. § 1.138(a) in U.S. Appl. No. 13/161,852, filed Jun. 16, 2011 in 2 pages.
A. Prosperetti, "No Nuclear Fusion' from glowing bubbles", http://ci.mond.org/9708/970810.html.
A. Takahashi, "comments on work on sonofusion of D in acetone", http://www.cf.ale.iwateu.ac.jp/jcf/mlist00042.html.
Brenner et al, "Single-bubble Sonoluminescence", Reviews on Modern Physics, Apr. 2002, vol. 74, pp. 425-484.
Brown, M.W., New Shot at Cold Fusion by Pumping Sound Waves Into Tiny Bubbles, New York Times, Dec. 20, 1994.
Browning, P.K. et al., "Power Flow in a Gun-Injected Spheromak Plasma", The American Physical Society, Physical Review Letters, vol. 68, No. 11, Mar. 16, 1992, pp. 1718-1721.
C. W. Hartman et al, "A Compact Torus Fusion Reactor Utilizing a Continuously Generated String of CT's. The CT String Reactor", CTSR Journal of Fusion Energy (2008), Nov. 2, 2007, vol. published online, Issue 27, pp. 44-48.
Fowler, T.K., "Pulsed Spheromak Fusion Reactors", Comments on Plasma Physics & Controlled Fusion, Comments on Modern Physics, vol. 1(3), Part C, 1999, pp. 83-98.
Fowler, T.K., "Pulsed Spheromak Reactor With Adiabatic Compression", Lawarence Livermore National Laboratory, in 13 pages, Mar. 29, 1999.
Fowler, T.K., "Stability of Spheromaks Compressed by Liquid Walls", Lawrence Livermore National Laboratory, in 9 pages, Aug. 17, 1999.
G. Pusch, "Why is acetone used in sonofusion experiments'?", website http://www.physics-talk.com.
H. S. McLean et al, "Design and operation of a passively switched repetitive compact toroid plasma accelerator", Fusion Technology, May 1998, vol. 33, pp. 252-272.
H.P. Furth, "The Tokamak," in Fusion, vol. 1, Magnetic Confinement, Part A. ed. Edward Teller, Academic Press, pp. 123-242, 1981.
C. W. Hartman et al, "Acceleration of Spheromak Toruses, Experimental results and fusion applications", OSTI ID: 5240480; DE90005312, Proceedings of 11th US/Japan workshop on field-reversed configurations and compact toroids; Nov. 7-9, 1989, Dec. 1, 1989, Los Alamos, NM, USA.
C.W. Hartman et al., "Acceleration of Compact Toruses and Fusion Applications", Workshop on Physics of Alternative Magnetic Confinement Schemes, UCRL-JC-106121 Preprint, Oct. 11, 1990, Issue UCRL-JC-106121 Prepr, Varenna, Italy.
D. Bohm, "Quantum Mechanics", Dover Ed, 1989, pp. 277-281.
D. Braaten, "'Ridiculously easy' test yields claim of energy triumph", Washington Times, Mar. 24, 1989.
C.W. Hartman et al., "Acceleration of Compact Torus Plasma Rings in a Coaxial Rail-Gun", 7th Symposium on Compact Toroid Research, Santa Fe, New Mexico, May 21-23, 1985, in 6 pages.
Ex parte Wilson Greatbatch, Decision on Appeal, Appeal 2009-010812, dated Jun. 29, 2011, in 7 pages.
Compact Toroid, Wikipedia, http://en.wikipedia.org/wiki/Compact_toroid, downloaded Mar. 14, 2014.
Bellan, P. M., "Spheromaks: A practical application of magnetohydrodynamic dynamos and plasma self-organization," Imperial College Press, 2000, pp. 1-9, 268-275.

* cited by examiner

SYSTEMS AND METHODS FOR PLASMA COMPRESSION WITH RECYCLING OF PROJECTILES

CROSS-REFERENCE TO RELATED APPLICATIONS

This application claims the benefit under 35 U.S.C. §119 (e) of U.S. Provisional Patent Application No. 61/229,355, filed Jul. 29, 2009, titled "SYSTEMS AND METHODS FOR PLASMA COMPRESSION AND HEATING WITH RECYCLING OF PROJECTILES," which is hereby incorporated by reference herein in its entirety.

BACKGROUND

1. Field

The present disclosure relates to embodiments of systems and methods for plasma compression.

2. Description of Related Art

Some systems for compressing plasma to high temperatures and densities typically are large, expensive, and are limited in repetition rate and operational lifetime. The addition of a magnetic field within the plasma is a promising method for improving the effectiveness of any given heating scheme due to decreased particle and energy loss rates from the plasma volume.

Methods of compressing a plasma include the following six schemes.

(1) Direct compression of a plasma using an external magnetic field that increases with time.

(2) Compression by an ablative rocket effect of an outer surface of an implosion capsule, with the compression driven by intense electromagnetic radiation or high energy particle beams (such as certain Inertial Confinement Fusion (ICF) devices). See, for example, R. W. Moir et al., "HYLIFE-II: An approach to a long-lived, first-wall component for inertial fusion power plants," Report Numbers UCRL-JC--117115; CONF-940933-46, Lawrence Livermore National Lab, August 1994, which is hereby incorporated by reference herein in its entirety.

(3) Compression by electromagnetic implosion of a conductive liner, typically metal, driven by large pulsed electric currents flowing in the implosion liner.

(4) Compression by spherical or cylindrical focusing of a large amplitude acoustic pulse in a conducting medium. See, for example, the systems and methods disclosed in U.S. Patent Application Publication Nos. 2006/0198483 and 2006/0198486, each of which is hereby incorporated by reference herein in its entirety. In some implementations, the compression of a conductive medium can be performed using an external pressurized gas. See, for example, the LINUS system described in R. L. Miller and R. A. Krakowski, "Assessment of the slowly-imploding liner (LINUS) fusion reactor concept", Rept. No. LA-UR-80-3071, Los Alamos Scientific Laboratory, Los Alamos, N. Mex. 1980, which is hereby incorporated by reference herein in its entirety.

(5) Passive compression by injecting a moving plasma into a static but conically converging void within a conductive medium, such that the plasma kinetic energy drives compression determined by wall boundary constraints. See, for example, C. W. Hartman et al., "A Compact Torus Fusion Reactor Utilizing a Continuously Generated String of CT's. The CT String Reactor", CTSR Journal of Fusion Energy, vol. 27, pp. 44-48 (2008); and "Acceleration of Spheromak Toruses: Experimental results and fusion applications," UCRL-102074, in Proceedings of 11th US/Japan workshop on field-reversed configurations and compact toroids; 7-9 Nov. 1989; Los Alamos, N. Mex., each of which is hereby incorporated by reference herein in its entirety.

(6) Compression of a plasma driven by the impact of high kinetic energy macroscopic projectiles, for example, by a pair of colliding projectiles, or by a single projectile impacting a stationary target medium. See, for example, U.S. Pat. No. 4,328,070, which is hereby incorporated by reference herein in its entirety. See, also, the above-incorporated paper by C. W. Hartmann et al., "Acceleration of Spheromak Toruses: Experimental results and fusion applications."

SUMMARY

An embodiment of a system for compressing plasma is disclosed. The system can include a plasma injector that comprises a plasma formation system configured to generate a magnetized plasma and a plasma accelerator having a first portion, a second portion, and a longitudinal axis between the first portion and the second portion. The plasma accelerator can be configured to receive the magnetized plasma at the first portion and to accelerate the magnetized plasma along the longitudinal axis toward the second portion. The system for compressing plasma may also include a liquid metal circulation system configured to provide liquid metal that forms at least a portion of a chamber configured to receive the magnetized plasma from the second portion of the plasma accelerator. The magnetized plasma can have a first pressure when received in the chamber. The system may also include a projectile accelerator configured to accelerate a projectile along at least a portion of the longitudinal axis toward the chamber. The system may be configured such that the projectile compresses the magnetized plasma in the chamber such that the compressed magnetized plasma can have a second pressure that is greater than the first pressure.

An embodiment of a method of compressing a plasma is disclosed. The method comprises generating a toroidal plasma, accelerating the toroidal plasma toward a cavity in a liquid metal, accelerating a projectile toward the cavity in the liquid metal, and compressing the toroidal plasma with the projectile while the toroidal plasma is in the cavity in the liquid metal. In some embodiments, the method may also include flowing a liquid metal to form the cavity. In some embodiments, the method may also include recycling a portion of the liquid metal to form at least one new projectile.

An embodiment of an apparatus for compressing plasma is disclosed. The apparatus can comprise a plasma injector configured to accelerate a compact toroid of plasma toward a cavity in a liquid metal. The cavity can have a concave shape. The apparatus can also include a projectile accelerator configured to accelerate a projectile toward the cavity, and a timing system configured to coordinate acceleration of the compact toroid and acceleration of the projectile such that the projectile confines the compact toroid in the cavity in the liquid metal.

BRIEF DESCRIPTION OF THE DRAWINGS

Throughout the drawings, reference numbers may be reused to indicate correspondence between referenced elements. The drawings are provided to illustrate example embodiments described herein and are not intended to limit the scope of the disclosure.

DETAILED DESCRIPTION

Overview

Figure 1:
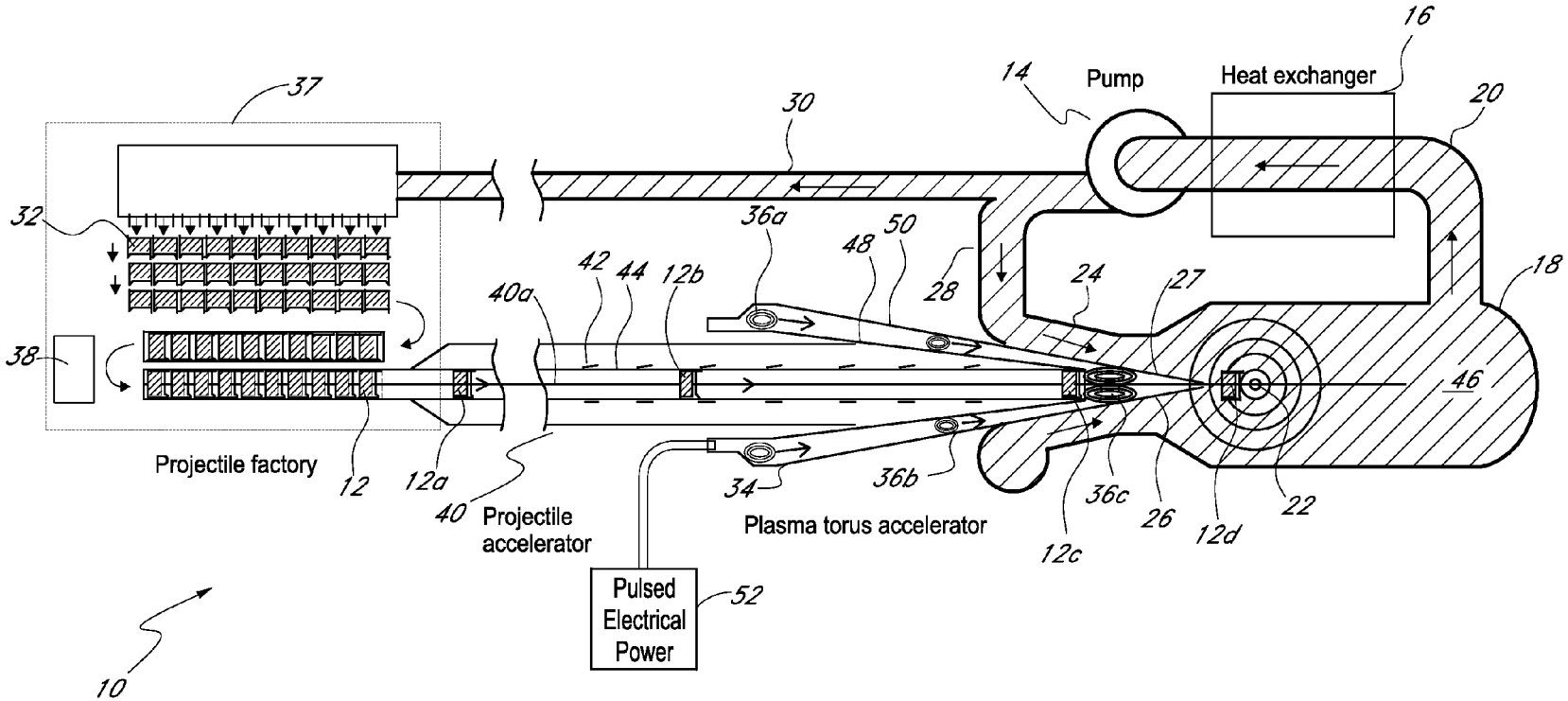
FIG. 1 is a schematic cross-sectional diagram showing an example embodiment of a plasma compression system with liquid metal wall confinement, where the system comprises a projectile acceleration device, a plasma injector, a liquid metal recirculating vessel and a projectile formation subsystem.

The plasma compression schemes described above have various advantages and disadvantages. However, a significant obstacle in the effective implementation of any plasma compression scheme is typically the monetary cost of constructing such a device at the necessary physical scale. For some of the above schemes, construction costs impede or even prohibit testing and development of prototypes at full scale. Thus it may be beneficial to consider technologies that can be affordably constructed in prototype and full-scale, using some conventional methods and materials, and which have relatively straightforward overall design and relatively small physical scale.

Embodiments of the above-described compression schemes are generally pulsed in nature. Two possible factors to consider are the cost per pulse and the pulse repetition rate. Schemes that use high precision parts that are destroyed each pulse cycle (for example, schemes 2, 3, and some versions of scheme 6) may typically have a significantly higher cost per pulse than schemes that are either non-destructive (for example, scheme 1) or employ passive recycling of material (for example, schemes 4, 5, and some versions of scheme 6). Non-destructive pulse schemes tend to have the highest repetition rate (which may be limited by magnetic effects) that may be as high as in a kHz range in certain implementations. Passive recycling may be the next fastest with repetition rates (which may be limited by liner fluid flow velocities) that may be as high as several Hz in certain implementations. Schemes where the central assembly for the pulsed compression is destroyed every pulse tend to have the slowest intrinsic repetition rate, determined by time taken to clear destroyed elements and insert a new assembly. This is not likely to be more than once every few seconds at best in some implementations.

Because of the potential for emission of intense x-rays and energetic particles from plasmas at high density and temperature, it may be advantageous to consider schemes that incorporate a large volume of replaceable absorber material to reduce the extent to which radiation products from the plasma reach the permanent structural elements of the compression device. Devices that do not incorporate such an absorber material or blanket may tend to suffer from radiation damage in their structural components and have correspondingly shorter operational lifetimes. While some embodiments of schemes 1, 2, and 3 can be adapted to accommodate some amount of absorber material, this can complicate the design (see for example, the HYLIFE-II reactor design described in the above-incorporated article by Moir et al.). In contrast, schemes 4, 5, and 6 incorporate an absorber material, either by choice of material used for the compression liner fluid, and/or by the addition of material into large unused volumes surrounding the device. Systems with a recirculating absorber fluid can also provide a low cost method for extracting heat produced during compression. Recirculation of an absorber fluid can also allow radiation products from the compressed plasma to be used to transmute isotopes included in the absorber fluid. This approach can be used for processing waste material, or for providing a cost effective method of producing rare isotopes.

Impact driven compression schemes have typically involved methods to accelerate small but macroscopic projectiles to the ultra-high velocities needed to compress and heat the solid projectiles into an extremely dense, hot plasma state, typically with no magnetic field, or a magnetic field with only marginal confinement properties. This typically requires the use of an extremely long electromagnetic accelerator (for example, up to several kilometer long) to develop the requisite velocity, resulting in prohibitive construction costs.

Various embodiments of the present disclosure address some of these and other challenges. For example, in most systems using projectiles, there has not been any method for recycling the projectile material, which results in the destruction of high-precision parts, greatly increasing the cost per pulse. In addition, the mechanisms for absorbing plasma radiation products for useful purposes has not been integrated into some prior designs, and so any absorber blanket must be added on as an afterthought, possibly with significant engineering complications.

Some embodiments of the present approach involve the use of the impact of a projectile to drive plasma compression, and provide a system configuration that enables a significantly smaller scale system with higher repetition rates and/or longer system lifetime than previous approaches. In contrast to some impact compression methods (see for example U.S. Pat. No. 4,435,354, which is hereby incorporated by reference herein in its entirety), certain embodiments of the present approach utilize a larger mass traveling at lower velocity, which acts to compress a well-magnetized plasma. This can allow for the use of a less complex and less costly projectile acceleration method for compressing the plasma. For example, a light gas gun can be used to accelerate the projectile to a speed of up to several km/s over a span of, for example, approximately 100 meters. Examples of light gas guns and projectile launchers that can be used with embodiments of the plasma compression system disclosed herein are described in U.S. Pat. No. 5,429,030 and U.S. Pat. No. 4,534,263, each of which is hereby incorporated by reference herein in its entirety. The projectile launcher described in the publication by L. R. Bertolini, et al., "SHARP, a first step towards a full sized Jules Verne Launcher", Report Number UCRL-JC--114041; CONF-9305233-2, Lawrence Livermore National Lab, May 1993, which is hereby incorporated by reference herein in its entirety, may also be used with embodiments of the plasma compression system.

Embodiments of the present approach may incorporate an integrated passive recycling system for the projectile material. This can allow for an improved (e.g., relatively high) repetition rate and/or an increase in system lifetime. With suitable choice of materials, the projectile and liner fluid can act as an efficient absorber of plasma radiation products, resulting in a system that has an economic feasibility and practical utility.

Example Systems and Methods for Compressing Plasma

Embodiments of systems and methods for plasma compression are described. In some embodiments, plasma can be compressed by impact of a projectile on a magnetized plasma toroid in a liquid metal cavity. The projectile can melt in the liquid metal cavity, and liquid metal can be recycled to form new projectiles. The plasma can be heated during compression.

With reference to the drawings, a schematic cross-sectional diagram of an embodiment of a new and improved example plasma compression system 10 is shown in FIG. 1. The example system 10 includes a magnetized plasma formation/injection device 34, an accelerator 40 (for example, a light gas pneumatic gun or an electromagnetic accelerator), which fires projectiles 12 along an acceleration axis 40*a* toward compression chamber 26 defined in part by a converging flow of liquid metal 46. Liquid metal 46 is contained within liquid metal recirculating vessel 18, and a conical nozzle 24 directs the flow of liquid metal 46 into a magnetic flux conserving liner having a surface 27 with a desired shape at compression chamber 26. The compression chamber 26 may be substantially symmetric around an axis. The axis of the compression chamber 26 may be substantially collinear with the acceleration axis 40*a* (see, e.g., FIGS. 1 and 2). The system 10 may include a timing system (not shown) configured to coordinate the relative timing of events such as, e.g., formation of the plasma, acceleration of the plasma, firing or acceleration of the projectile, etc. For example, since, in some embodiments, the projectile velocity may be significantly less than the plasma injection velocity, plasma formation and injection can be delayed and can be triggered by the timing system when the projectile 12 reaches a prescribed position (e.g., near the muzzle) of the accelerator 40.

FIG. 1 schematically illustrates three example projectiles 12*a*, 12*b*, and 12*c* moving toward the compression chamber 26. A fourth projectile 12*d* is in the liquid metal 46 near the point of maximum compression of the plasma. The four projectiles 12*a*-12*d* are intended to illustrate features of the system 10 and are not intended to be limiting. For example, in other embodiments, different numbers of projectiles (e.g., 1, 2, 4, or more) may be accelerated by the accelerator 40 at any time. FIG. 1 also schematically illustrates a plasma torus in three different positions in the system 10. In the illustrated embodiment, the magnetized plasma torus can be formed near a formation region 36*a* of the formation/injection device 34. The magnetized plasma shown at the position 36*b* has been accelerated and compressed between coaxial electrodes 48 and 50. At the position 36*c*, near the muzzle of the accelerator 40, the magnetized plasma expands off the end of the coaxial electrodes 48 and 50 into the larger volume of the compression chamber 26 defined by the front surface of projectile 12*c* (see FIG. 1) and the surface 27 of the liquid metal. The magnetized plasma can persist at the position 36*c* in the compression chamber 26 with a magnetic decay time that is several times longer than the compression time.

The motion of the projectile 12*c* can compress the plasma near the position 36*c*, with the internal magnetic confinement of the plasma reducing or preventing significant particle loss back up into the plasma injector during the early phase of compression. In the system 10 schematically illustrated in FIG. 1, the size of the projectile 12*c* transverse to the acceleration axis 40*a* is smaller than the size of the opening to the compression chamber 26 so that an annular opening exists around the outside of the projectile when the projectile is near the position 36*c*. A later phase of compression begins after the projectile 12*c* closes off the opening to the chamber, and the compression chamber 26 is substantially or fully enclosed by the surface 27 of the liquid metal and the projectile 12*c*. See, e.g., FIG. 3 which schematically depicts a simulated time sequence of the compression geometry. Therefore, impact of the projectile 12 on the plasma in the compression chamber can increase the pressure, density, and/or temperature of the plasma. For example, the plasma may have a first pressure (or density or temperature) when in the compression chamber 26, and a second pressure (or density or temperature) after impact of the projectile 12, the second pressure (or density or temperature) greater than the first pressure (or density or temperature). The second pressure (or density or temperature) can be greater than the first pressure (or density or temperature), for example, by a factor of 1.5, 2, 4, 10, 25, 50, 100, or more. After the projectile is engulfed in liquid metal 46 (depicted in FIG. 1 as projectile 12*d*), the projectile can rapidly disintegrate and melt back into the metal 46. As will be further described below, liquid metal 46 from the vessel 18 can be recycled to form new projectiles.

As a result of the compression, the plasma may be heated. Net heating of the liquid metal 46 can occur due to the absorption of radiation products from the compressed plasma as well as thermalization of the projectile kinetic energy. For example, in some implementations, the liquid metal 46 can be heated by as much as several hundred degrees Celsius by the plasma compression event. Thus, as shown in the example in FIG. 1, as the liquid metal 46 is recirculated by a pump 14, the liquid metal can be cooled via a heat exchange system 16 to maintain a desired temperature at inlet pipe 28 or at the conical nozzle 24. In some implementations, heat generated by plasma compression can extracted by the heat exchanger and used in an electrical power generation system (e.g., a turbine driven by steam generated from the extracted heat). In some embodiments, the temperature of the liquid metal can be maintained moderately above its melting point (e.g., $T_{melt}$+approximately 10-50° C.). The heat exchanger 16 can be any suitable heat exchanger.

In some embodiments, the heat exchanger output may be used in other processes. For example, in addition to the inlet pipe 28 which directs the flow of liquid metal 46 to the conical nozzle 24 to create the surface 27 of the compression chamber 26, a recirculation pipe 30 can deliver a supply of the liquid metal 46 to projectile molds 32 in a subsystem for making new batches of projectiles (e.g., projectile factory 37 shown in FIG. 1). In some embodiments, a loading mechanism 38 can be used to automatically load new projectiles into the breach of the accelerator 40. In certain embodiments, an array of projectiles 12 can be situated within a cartridge structure that can be loaded by the loading mechanism 38 into the breach of the accelerator 40 and fired in relatively rapid sequence along the acceleration axis 40*a*. In some cases, a brief time period, possibly as brief as 1-2 seconds in some implementations, without the accelerator 40 firing can be provided to allow for loading of the next cartridge of projectiles. In some embodiments, the loading mechanism 38 can have a direct load-shoot-load-shoot cycle in which case a cartridge structure need not be used, and a substantially steady rate of projectile fire can be maintained.

In some embodiments, projectile molds 32 can be automated to receive recycled liquid metal 46, and provide a cooling cycle suitable to allow casting of new projectiles using various manufacturing methods. The rate of liquid metal recirculation and new projectile production can be sufficient to supply projectiles at the desired launch rate. The total cooling time for the liquid metal to sufficiently solidify within the molds can be taken up by parallelism within the method of preparing batches of new projectiles. In some implementations of the system 10, the cooling time may be made as short as practical and/or may be determined by the amount of rigidity needed for proper mechanical function of the loading mechanism and/or the ability of the projectile 12 to survive acceleration down the gun. With this highly automated firing cycle, a reasonably high repetition rate can be achieved for extended durations. Also, with the possible exception of injecting plasma for each shot, certain embodiments of the system 10 have the advantages of being effectively a closed-loop in which the solid projectile 12 can be fired into a vessel 18 filled with substantially the same material in liquid form, and the liquid metal 46 can be recycled to form new projectiles 12. In some embodiments, manufacturing of projectiles can be performed using the systems and methods described in, e.g., U.S. Pat. No. 4,687,045, which is hereby incorporated by reference herein in its entirety.

The system 10 may be used in a variety of practical and useful applications. For example, in applications involving transmutation of isotopes by absorption of radiation products, there can be another branch of the liquid metal flow cycle (not shown) in which isotopes may be extracted from the liquid metal 46, for example, using standard getter-bed techniques. If necessary in some embodiments, additional metal may be added to the flow to replenish amounts that are lost to transmutation or other losses or inefficiencies.

In some implementations of the system 10, some or all of the recirculating liquid metal system may be similar to the systems used for some implementations of the above-described compression schemes 4 and 5. Certain implementation of this scheme may be different than certain implementations of scheme 4 in that no vortex hydrodynamics are used to create the central cavity of compression chamber 26, instead linear nozzle flow may be used. Some implementations of the present approach may also be different than some implementations of scheme 4 in that only a single projectile is used to drive each compression, and synchronization of the impact of a number of pistons used to create a substantially symmetric acoustic pulse may not be needed.

Certain embodiments of the present approach also have some possible advantages over scheme 5, which typically uses a significantly longer and more powerful plasma injector to develop the kinetic energy needed to develop full compression of the plasma, resulting in a higher construction cost due to the price of capacitive energy storage. In some embodiments of the present approach, the energy that can be used to compress the plasma may be primarily derived from pressurized gas that accelerates the projectile 12 in the accelerator 40. In some cases, this may be a less complex and less expensive technology than used in certain implementations of scheme 5.

Embodiments of the plasma compression system 10 can include the accelerator 40 for firing a projectile 12 along a substantially linear path that passes along the axis 40*a* substantially through the center of the plasma injector 34 and ends in impact with the plasma and liquid metal walls of compression chamber 26 within the recirculating vessel 18. In some embodiments, the accelerator 40 may be configured so that it can efficiently obtain high projectile velocities (such as, for example, approximately 1-3 km/s) for a large caliber projectile (such as, for example, approximately 100 kg mass, approximately 400 mm diameter) and can be able to operate in a mode of automated repeat firing. There are a number of known accelerator devices that may be adapted for this application. One possible approach can be to use a light gas gun. In some implementations, the design of the gun may allow rapid recharging of the plenum volume behind the projectile with a pressurized light "pusher gas" (which may comprise, e.g., hydrogen or helium). In some implementations, it may be advantageous for the region in front of the projectile to be at least partially evacuated before subsequent firing of the gun. For example, as a projectile 12 moves forward, it can push a fraction of the gas in its path into compression chamber 26. Depending on the gas composition, this may possibly contaminate the plasma that is injected into compression chamber 26. The presence of another (impurity) gas may in some cases cool the plasma through emission of line radiation, which reduces the energy available for heating the plasma. In embodiments in which hydrogen is used as the pusher gas, the hydrogen can be fully ionized and incorporated into the plasma without a high probability of such cooling problems. Further, residual gas in front of the projectile acts as a drag force, slowing the projectile's acceleration in the gun. Thus, in embodiments with at least a partial vacuum in front of the projectile, enhanced gun efficiency may be achieved.

In some embodiments, a conventional light gas gun may provide for rapid evacuation of gun barrel 44 during the intershot time period. For example, in one possible gun design, the main gun barrel 44 may be surrounded by a significantly larger vacuum tank (not shown in FIG. 1), with a large number of actuatable vent valves 42 distributed along the length of gun 44. One possible example method of operation of the valves includes the following. During the intershot time period all (or at least a substantial fraction) of the valves 42 can be open and the pusher gas from previous projectile firing can be exhausted into the vacuum tank. Once the valves open, without including the effect of outflow due to active pumping at the surface of the vacuum tank, an estimate for the initial equilibrium pressure is $$P_{equ}P_{push}V_{gun}/V_{tank}=P_{push}(r_{gun}/r_{tank})^2,$$

where $P_{push}$ is the final pressure in the gun after the projectile has left the muzzle, $V_{gun}$, $V_{tank}$ are the volumes of the gun barrel 44 and vacuum tank respectively, which for a coaxial cylindrical gun-tank system is also proportional to the square of the ratios of the radii of the gun barrel and the tank. For example, if $(r_{gun}/r_{tank})=1/10$, and the final pushing pressure is $P_{push}=1$ atmosphere (where 1 atmosphere is approximately $1.013\times10^5$ Pa), then the initial equilibrium pressure would be about 1/100 of an atmosphere. In certain system embodiments, this volumetric drop in pressure allows the use of standard high-speed turbo pump technology for evacuating the system, which typically are not used at the very high pressures provided in some gas gun designs. In certain such embodiments, the vacuum turbo pumps (not shown) may be distributed along the surface of the vacuum tank and, in the case of pumping in parallel, may have a combined pumping rate that equals or exceeds the time averaged gas inflow rate due to injection of the pusher gas to drive the projectile. One possible arrangement can be a closed-loop for the pusher gas, in which compressors take the exhaust from the vacuum pumps and pressurize the gun plenum directly. Heat energy from the heat exchange system 16 can additionally or alternatively be used to thermally pressurize the gas in the plenum.

Continuing with the example method of valve operation, once the pressure in the gun 40 is reduced to sufficient levels, valves 42 can start to close and may be synchronized such that the valves closest to the breach of the gun 40 may fully close first. In some cases, the time of full closing of valves 42 can be staggered in a linear sequence along the length of gun 40, such that it tracks the trajectory of the projectile. Other synchronization patterns can be used. With suitable synchronization, some embodiments of the gun 40 can be configured to fire another projectile 12 as soon as the valves 42 near the breach have closed, and then as the projectile 12 advances down the gun 40, the projectile can pass by newly closed valves, with the valves ahead of the projectile being in the process of closing, yet still open enough for any residual gas to be pushed out into the vacuum tank. Other gun firing patterns may be used in other embodiments.

Figure 5:
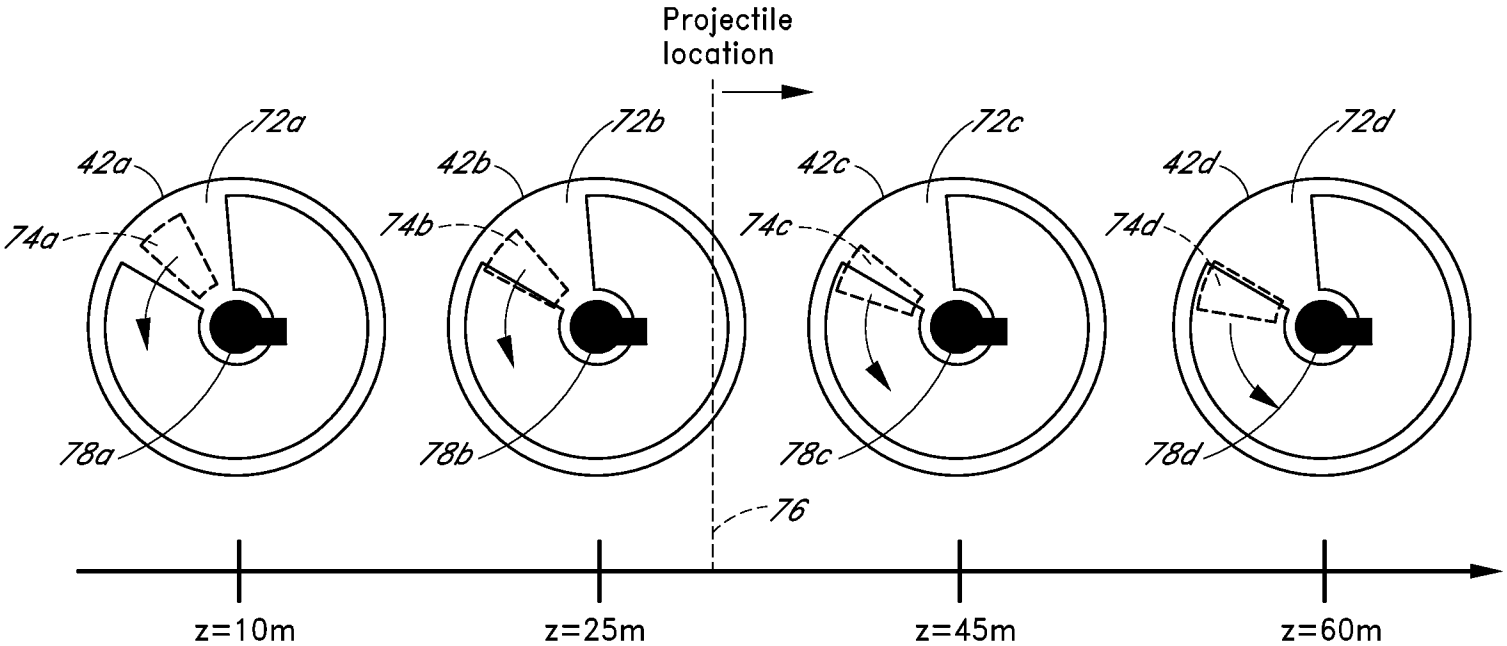
FIG. 5 schematically shows an example of timing of gas vent valves in an example embodiment of a projectile accelerator.

Actuated vent valves 42 may, for example, operate via motion that may be linear or rotary in nature. FIG. 5 schematically illustrates an example of timing of rotary gas vent valves 42*a*-42*d* in an embodiment of a projectile accelerator. Motors 78*a*-78*d* may be used to rotate valve rotors 72*a*-72*d*, respectively. In this example, the timing can be arranged such that the valve rotors 72*a* and 72*b* at least partially closed over one or more vent holes 74*a* and 74*b*, respectively, behind the location 76 of the projectile (which is moving to the right in this example), and valve rotors 72*c* and 72*d* leave at least partially open one or more vent holes 74*c* and 74*d*, respectively, ahead of the location 76 of the projectile such that gas can be at least partially confined in the region behind the projectile, while the region in front of the projectile can be at least partially evacuated. In some implementations, recycling of the pusher gas through the system may require significant energy expenditure during a short (e.g., sub-second) intershot time period. In other methods of gun operation, the vent valves (if used) may be operated differently than described above.

In certain embodiments, the repetition rate of the projectile acceleration system can be greater than or equal to the intrinsic repetition rate of the compression scheme. In other embodiments, the repetition rate of the projectile acceleration system can be less than the intrinsic repetition rate of the compression scheme.

Other projectile acceleration methods may be used. For example, another possible method of projectile acceleration includes use of an inductive coil gun, which in some embodiments, uses a sequence of pulsed electromagnetic coils to apply repulsive magnetic forces to accelerate the projectile. One possible advantage of the inductive coil gun may be that the coil gun can be maintained at a high state of evacuation in a steady fashion.

In some embodiments of the system 10, additional sensors (not shown) and a triggering circuit (not shown) may be incorporated for precise triggering of firing the accelerator 40.

Embodiments of the projectile 12 and/or the liquid metal 46 can be made from a metal, alloy, or combination thereof. For example, an alloy of lead/lithium with approximately 17% lithium by atomic concentration can be used. This alloy has a melting point of about 280° C. and a density of about 11.6 g/cm$^3$. Other lithium concentrations can be used (e.g., 5%, 10%, 20%), and in some implementations, lithium is not used. In some embodiments, the projectile 12 and the liquid metal 46 have substantially the same composition (e.g., in some pulsed, recycled implementations). In other embodiments, the projectile 12 and the liquid metal 46 can have different compositions. In some embodiments, the projectile 12 and/or the liquid metal 46 can be made from metals, alloys, or combinations thereof. For example, the projectile and/or the liquid metal may comprise iron, nickel, cobalt, copper, aluminum, etc. In some embodiments, the liquid metal 46 can be selected to have sufficiently low neutron absorption that a useful flux of neutrons escapes the liquid metal.

Embodiments of the plasma torus injector 34 may be generally similar to certain known designs of the coaxial railgun-type. See, for example, various plasma torus injector embodiments described in: J. H. Degnan, et al., "Compact toroid formation, compression, and acceleration," Phys. Fluids B, vol. 5, no. 8, pp. 2938-2958, 1993; R. E. Peterkin, "Direct electromagnetic acceleration of a compact toroid to high density and high speed", Physical Review Letters, vol. 74, no.16, pp. 3165-3170, 1995; and J. H. Hammer, et al., "Experimental demonstration of acceleration and focusing of magnetically confined plasma rings," Physical Review Letters, vol. 61, no. 25, pp. 2843-2846, December 1988. See, also, the injector design that was experimentally tested and described in H. S. McLean et al., "Design and operation of a passively switched repetitive compact toroid plasma accelerator," Fusion Technology, vol. 33, pp. 252-272, May 1998. Each of the aforementioned publications is hereby incorporated by reference herein in its entirety. Also, embodiments of the plasma generators described in U.S. Patent Application Publication Nos. 2006/0198483 and 2006/0198486, each of which is hereby incorporated by reference herein in its entirety for all it discloses, can be used with embodiments of the plasma torus injector 34.

The toroidal plasma generated by the plasma injector 34 can be a compact toroid such as, e.g., a spheromak, which is a toroidal plasma confined by its own magnetic field produced by current flowing in the conductive plasma. In other embodiments, the compact toroid can be a field-reversed configuration (FRC) of plasma, which may have substantially closed magnetic field lines with little or no central penetration of the field lines.

Some such plasma torus injector designs can produce a high density plasma with a strong internal magnetic field of a toroidal topology, which acts to confine the charged plasma particles within the core of the plasma for a duration that can be comparable to or exceeds the time of compression and rebound. Embodiments of the injector can be configured to provide significant preheating of the plasma, for example, ohmically or resistive heating by externally driving currents and allowing partial decay of internal magnetic fields and/or direct ion heating from thermalization of injection kinetic energy when the plasma comes to rest in the compression chamber 26.

Figure 2:
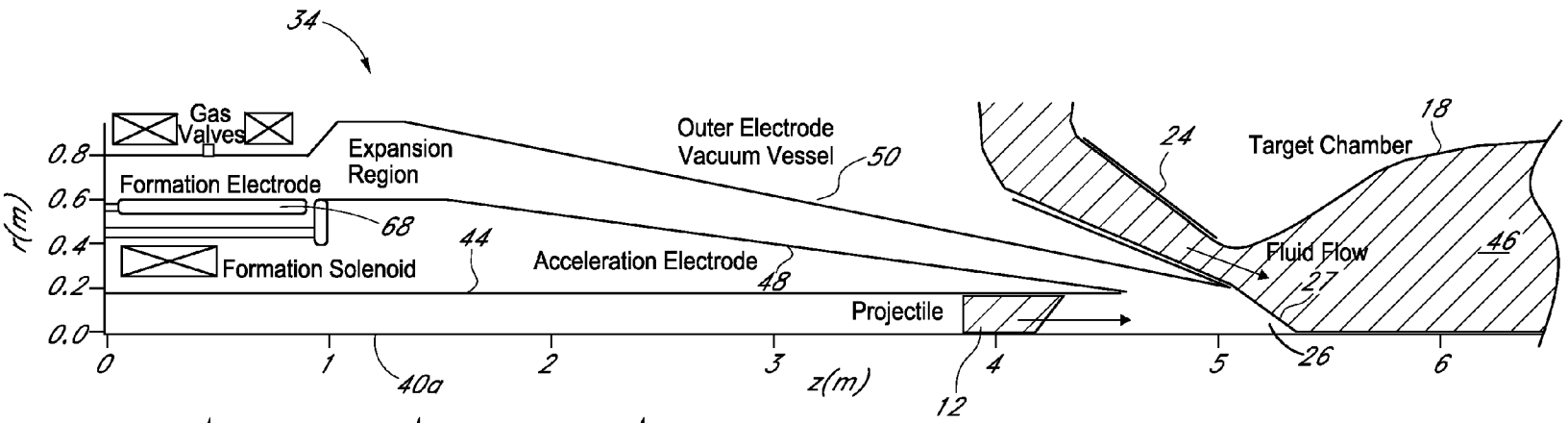
FIG. 2 is a schematic cross-sectional diagram showing a portion of an example embodiment of a plasma injector located coaxially around the muzzle of a projectile accelerator. In the illustrated embodiment, the plasma injector is rotationally symmetric around the projectile acceleration axis 40*a*.

As schematically shown in FIG. 2, some embodiments of the plasma injector 34 can include several systems or regions: a plasma formation system 60, a plasma expansion region 62, and a plasma acceleration/focusing system or accelerator 64. In the embodiment shown in FIG. 2, the plasma acceleration/focusing system or accelerator 64 is bounded by electrodes 48 and 50. One or both of the electrodes 48, 50 may be conical or tapered to provide compression of the plasma as the plasma moves along the axis of the accelerator 64. In the illustrated embodiment, the formation system 60 has the largest diameter and includes a separate formation electrode 68, coaxial with the outer wall of the plasma formation system 60, which can be energized in order to ionize the injected gas by way of a high voltage, high current discharge, thereby forming a plasma. The plasma formation system 60 also can have a set of one or more solenoid coils that produce the initial magnetic field prior to the ionization discharge, which then becomes imbedded within the plasma during the formation. After being shaped by plasma processes during the expansion and relaxation in the expansion region 60, the initial field can develop into a set of closed toroidal magnetic flux surfaces, which can provide strong particle and energy confinement, which is maintained primarily by internal plasma currents.

Once this magnetized plasma torus 36 has been formed, an acceleration current can be driven from the center conical accelerator electrode 48 across the plasma, and back along the outer electrode 50. The resulting Lorentz force (J×B) accelerates the plasma down the accelerator 64. The plasma accelerator 64 can have an acceleration axis that is substantially collinear with the accelerator axis 40*a*. The converging, conical electrodes 48, 50 can cause the plasma to compress to a smaller radius (e.g., at the positions 36*b*, 36*c* as schematically shown in FIG. 1). In some embodiments, a radial compression factor of about 4 can be achieved from a moderately-sized injector 34 that is approximately 5 m long with an approximately 2 m outer diameter. This can result in an injected plasma density that can be about 64 times the original density in the expansion region of the injector, thus providing the impact compression process with a starting plasma of high initial density. In other embodiments, the compression factor may be, e.g., 2, 3, 5, 6, 7, 10, or more. In some embodiments, compression in the plasma accelerator is not used, and the system 10 compresses the plasma primarily through impact of the projectile on the plasma. In the illustrated embodiment, electrical power for formation, magnetization and acceleration of the plasma torus can be provided by pulsed electrical power system 52. The pulsed electrical power system 52 may comprise a capacitor bank. In other embodiments, electrical power may be applied in a standard way such as described in, e.g., J. H. Hammer, et al., "Experimental demonstration of acceleration and focusing of magnetically confined plasma rings," Physical Review Letters, vol. 61, no. 25, pp. 2843-2846, December 1988, which is hereby incorporated by reference herein in its entirety.

Embodiments of the liquid metal circulating vessel 18 may be configured to have a central substantially cylindrical portion that is shown in cross-section in FIG. 1, and which supports a net flow of liquid metal along the axial direction that enters the main chamber through a tapered opening 24 (conical nozzle) at one end and exits at the opposing end through a pipe 20 or a set of such pipes. Also shown in FIG. 1 is an optional recirculation pipe 30 for directing liquid metal 46 to projectile molds 32. Optionally recirculation pipe 30 may be a separate pipe from another region of vessel 18. In various embodiments, flow velocities in the liquid metal 46 can range from a few m/s to a few tens of m/s, and in some implementations, it may be advantageous for substantially laminar flow to be maintained substantially throughout the system 10. To promote laminar flow, honeycomb elements may be incorporated into vessel 18. Directional vanes or hydrofoil structures may be used to direct the flow into the desired shape in the compression region. The cone angle of the converging flow can be chosen to improve the impact hydrodynamics for a given cone angle of the projectile shape. Recirculating vessel 18 may be made of materials of sufficient strength and thickness to be able to withstand the outgoing pressure wave that emanates from the projectile impact and plasma compression event. Optionally, special flow elements near the exit of the vessel 18 (or at other suitable positions) may be used to dampen pressure waves that might cause damage to the heat exchange system. Optionally heaters (not shown) may be used to increase the liquid metal temperature above its melting point for startup operations or after maintenance cycles. In certain embodiments, the systems and methods for liquid metal flow disclosed in U.S. Patent Application Publication Nos. 2006/0198483 and 2006/0198486, each of which is hereby incorporated by reference herein in its entirety for all it discloses, can be used with the system 10.

During the projectile acceleration and impact there may be significant momentum transfer resulting in recoil forces applied to the structures of the apparatus. In some implementations, the mass of the bulk fluid in the recirculation vessel 18 can be sufficient (for example, greater than about 1000 times the mass of the projectile) that recoil forces from the impact can be handled by mounting vessel 18 on a set of stiff shock absorbers so that the displacement of vessel 18 may be on the order of about one cm. The accelerator 40 may also experience a recoil reaction as it acts to accelerate the projectile. In some embodiments, the accelerator 40 may be a few hundred times as massive as the projectile 12, and the accelerator 40 may tend to experience correspondingly higher recoil accelerations, and total displacement amplitude during firing, than the vessel 18. With these finite relative motions, the three system components in the illustrated embodiment (e.g., the accelerator 40, the plasma injector 34, and the recirculating vessel 18) can advantageously be joined by substantially flexible connections such as, e.g., bellows, in order to maintain a desired vacuum and fluid seals. During full operation of some systems 10, the driving force may be approximately periodic at a frequency of a few Hz (e.g., in a range from about 1 Hz to about 5 Hz). Therefore, it may be advantageous for the mechanical oscillator system (e.g., mass plus shock absorber springs) to be constructed to have a resonant frequency significantly different from the driving frequency, and that strong damping be present.

In some embodiments, the size of the recirculating vessel 18 can be selected such that the volume of liquid metal 46 surrounding the point of maximum compression 22 provides enough absorption of radiation by an absorber element (e.g., lithium) so there may be very little, if any, radiation transfer to solid metal structures of the system 10. For example, in some embodiments, a liquid thickness of approximately 1.5 meters for a lead/lithium mixture of about 17% Li atomic concentration may reduce the radiation flux to the solid support structure by a factor of at least about $10^4$.

Figure 3:
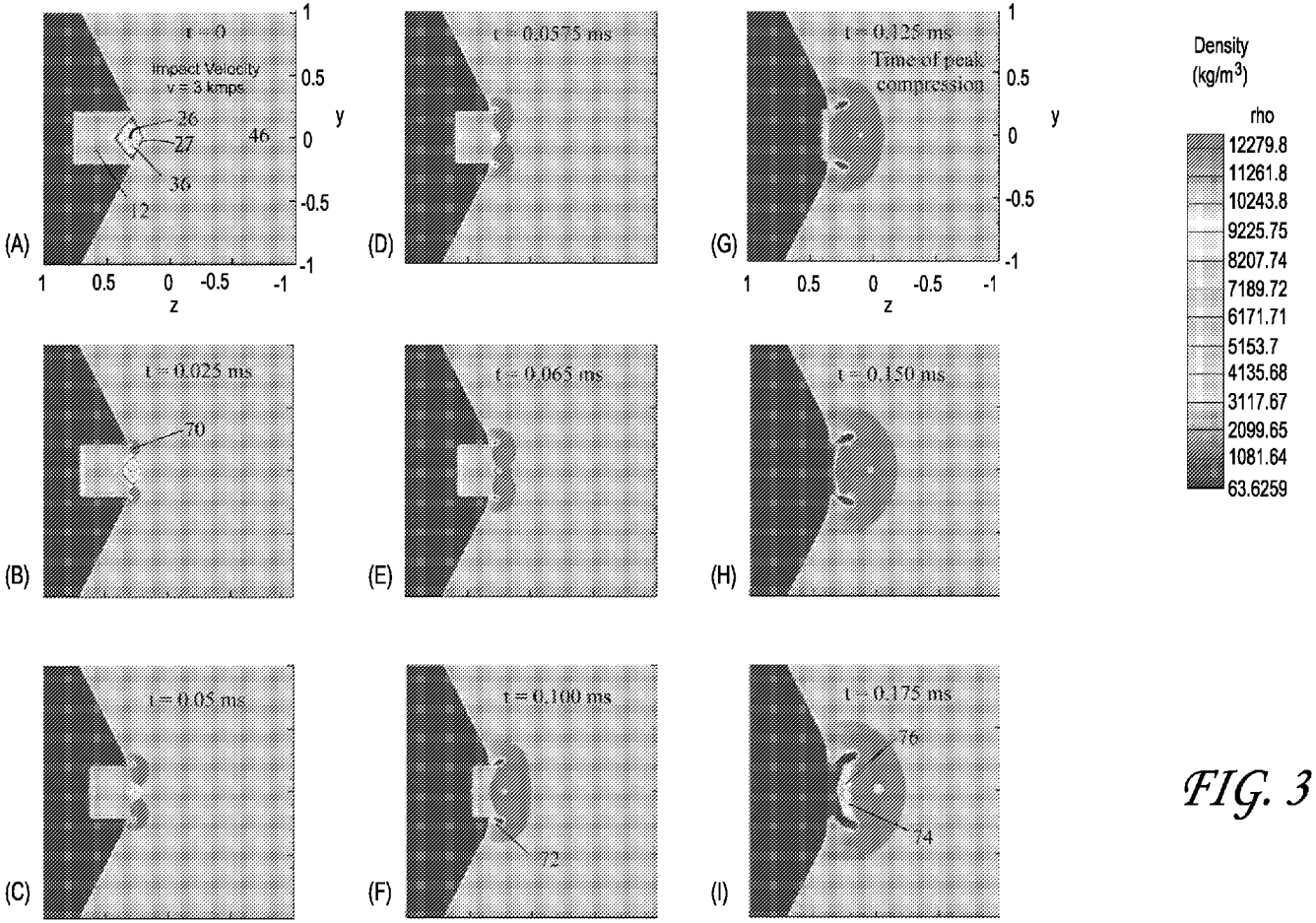
FIG. 3 includes simplified schematic cross-sectional diagrams (A-I) that illustrate an example, in a time sequence, of how a projectile and plasma may behave from impact with a liquid metal to point of maximum pressure, and then subsequent fracture of projectile and intermixing with the liquid metal used for recycling of projectile material. Values of density in $kg/m^3$ are illustrated as grayscale levels according to the values in the status bar on the right of the figure.

FIG. 3 shows cross-sectional diagrams (A-I) schematically illustrating a time-sequence of an example of possible compression geometry during an impact of a projectile 12 on a fluid comprising liquid metal 46. The diagrams show the density of the fluid and the projectile material during the impact event. The diagrams are based on a simulation using an inviscid finite volume method on a fixed mesh, and where the plasma volume 36 has been added in by hand to schematically illustrate the approximate dynamics of collapse. In this example, prior to the time shown in diagram A, the accelerator 40 launches the projectile 12, which passes sensors near the end of the muzzle that in turn trigger the firing sequence of the plasma injector. The plasma torus in this example can then be injected into the steadily closing volume between the projectile 12 and the conical surface 27 of the compression chamber 26 formed in part by the flow of the liquid metal 46. As the projectile 12 impacts the compression chamber 26, the plasma torus 36 in this example is substantially uniformly compressed to a smaller radius into the conical compression chamber 26 formed by the liquid metal flow. The plasma may be compressed such that there can be an increase in density (or pressure or temperature) by a factor of two or more, by a factor of four or more, by a factor of 10 or more, by a factor of 100 or more, or by some other factor.

When the leading tip of the projectile 12 impacts the surface 27 of the liquid metal (as shown in diagram A), the plasma 36 becomes sealed within a closed volume. As the edge of the projectile begins to penetrate the liquid metal (e.g., as shown in diagrams B, C, and D) the rate of compression increases. For a projectile impact velocity at or exceeding the speed of sound in the liquid metal, the impact can produce a bow shock wave that moves with the projectile.

Figure 4A:
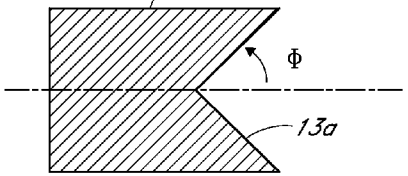
FIGS. 4A-4F are schematic cross-sectional diagrams that illustrate various example embodiments of projectiles.
Figure 4B:
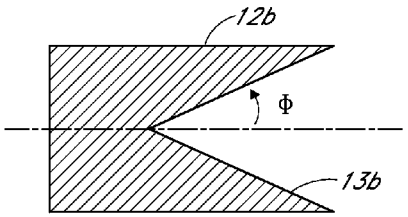
Figure 4C:
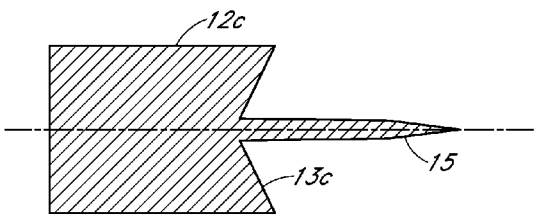
Figure 4D:
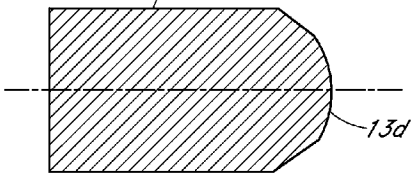
Figure 4E:
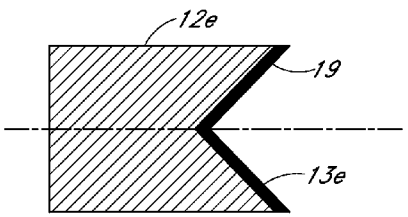
Figure 4F:
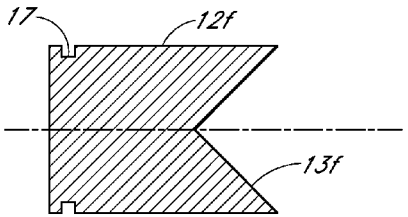

The front surface of the projectile 12 may comprise a shaped portion to increase the amount of compression. For example, in the illustrative simulation depicted in FIG. 3, the projectile 12 comprises a concave, cone-shaped front portion (see, e.g., FIG. 4A). In some embodiments, the angle of the projectile cone may be selected to be substantially the same as the angle of the bow shock for a given impact velocity. In some such embodiments, this selection of cone angle may be such that the compression occurs during the slowing down time of the projectile 12 rather than earlier during the crossing of the bowshock, which can be ahead of the surface of the projectile 12.

As the projectile 12 first encounters resistance from the impact, a compressional wave 70 can be launched backward through the projectile causing bulk compression of the projectile, while at the same time the normal impact force tends to cause a flaring of the opening of the projectile and begins the process of deformation. On the outer edge of the projectile a possibly turbulent wake 72 may form in the liquid. As the projectile slows below the liquid metal speed of sound (e.g., diagram E), a compressional wave 70 can also be launched forward into the liquid metal flow. Peak compression of the plasma may occur after this compression wave has passed beyond the compression chamber 26 (e.g., diagram F). When the backwards going compression wave reaches the back surface of the projectile it can reflect, yielding a decompression wave 74 that propagates forward through the projectile. After the decompression wave reaches the plasma containing cavity, the collapse of the inner wall surface may begin to decelerate in pace, stagnate at peak plasma pressure, temperature and magnetic field strength and then begin to re-expand, driven by the increased net pressures in the plasma.

As an illustrative, non-limiting example, for the case of a 100 kg projectile traveling at an impact speed of 3 km/s, having a kinetic energy of 450 MJ, there may be an energy transfer time of approximately 200 microseconds, resulting in an average power of $2\times10^{12}$ Watts. Since the time of peak compression may be approximately ½ the energy transfer time, and there can be an angular divergence of energy into the fluid with approximately ⅓ of the energy going into compressing the plasma at any given time. For example, in this illustrative simulation, there may be a maximum of approximately ⅙ of the total energy going into compressing the plasma. Thus, in this illustrative simulation, approximately 75 MJ of work would be done to compress the plasma. After the projectile has become fully immersed in the liquid metal flow, the projectile may develop fracture lines 76 and begin to break up into smaller fragments, which remelt into the flow over the span of several seconds or less.

The projectile 12 shown in the simulations illustrated in FIG. 3 comprises a concave, conical surface. There are other possible projectile designs that may provide different compression characteristics, and some examples of projectile designs 12*a*-12*f* are schematically shown in FIGS. 4A-4F, respectively. The projectiles 12*a*-12*f* have a surface 13*a*-13*f*, respectively, that confines the liquid metal in the compression chamber 26. In some embodiments, the surface can be substantially conical, and portions of the surface may be concave or convex. Other surface shapes can be used, e.g., portions of spheres, other conic sections, etc. In some embodiments comprising a conical surface, one possible parameter that may be adjusted to provide various concave surface designs is a cone angle, shown as angle Φ in FIGS. 4A and 4B. The cone angle can be chosen to improve the shock and flow dynamics as the projectile impacts the liquid metal liner. The cone angle Φ is larger in the projectile 12*a* than in the projectile 12*f*. The cone angle Φ can be about 20 degrees, about 30 degrees, about 40 degrees, about 45 degrees, about 50 degrees, about 60 degrees, or some other angle. In various embodiments, the cone angle Φ can be in a range from about 20 degrees to about 80 degrees, in a range from about 30 degrees to about 60 degrees, etc.

In some embodiments, the projectile 12*c* includes an elongated member 15 (e.g., a central spike; see FIG. 4C) that can act to continue the center electrode of the plasma injector 34. In some implementations of the system 10, such an elongated member 15 may prevent flipping of the magnetized plasma torus when it comes off the plasma injector 34. In some such implementations, the plasma advantageously can be injected just as the forward end of the spike 15 contacts the liquid metal 46 in the compression chamber 26, and the plasma volume can be maintained in a substantially toroidal topology during the compression. Such implementations may advantageously allow for better magnetic confinement than a spherical collapse topology, but may have more surface area of metal exposed directly to the plasma, which may possibly increase impurity levels and lower the peak plasma temperature in some cases.

In some projectile designs, it can also be possible to have plasma compression less dominated by the fluid shock effect by using an appropriately shaped convex projectile 12*d* (see, for example FIG. 4D), which may compress the plasma for a significant fraction of total collapse time before the projectile intersects the liquid metal surface. To reduce or mitigate plasma impurities, the surface 13*e* of the projectile 12*e* may comprise a coating 19 formed from a second material (see, for example, FIG. 4E), such as, for example, lithium or lithium-deuteride. Other portions of the projectile may include one or more coatings. Materials such as these typically are less likely to introduce impurities that may lead to, e.g., undesired plasma cooling if the impurities are swept into the edge of the plasma. In some embodiments, multiple coatings may be used. In some designs, the projectile may have features such as, e.g., grooves and/or indentations, around its surface to accommodate mechanical functioning of the loading system, or as a seal for a pneumatic accelerator gun. The projectile 13*f* schematically illustrated in FIG. 4F has a groove 17 around the circumference of the back edge into which a reusable sealing flange may be fitted, for example, during the initial casting of the projectile. In some embodiments using a pneumatic gun to accelerate the projectile 12*f*, the firing of the projectile 12*f* may occur when the pusher gas reaches sufficiently high pressure that the lead ring behind the sealing flange may be sheared off, thus freeing the projectile for acceleration, somewhat like the action of a burst diaphragm in a conventional gas gun.

Figure 6:
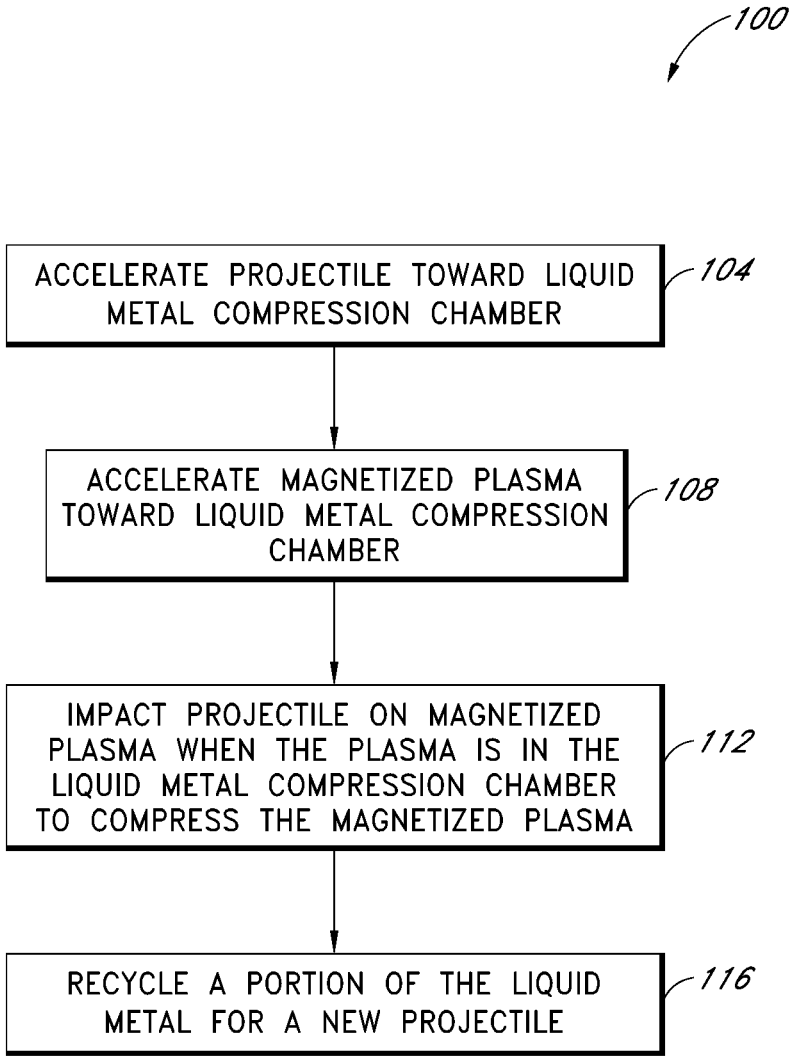
FIG. 6 is a flowchart that schematically illustrates an example embodiment of a method of compressing plasma in a liquid metal chamber using impact of a projectile on the magnetized plasma.

FIG. 6 is a flowchart that schematically illustrates an example embodiment of a method 100 of compressing plasma in a liquid metal chamber using impact of a projectile on the plasma. At block 104, a projectile 12 is accelerated towards a liquid metal compression chamber. The projectile can be accelerated using an accelerator such as, e.g., the accelerator 40. For example, the accelerator can be a light gas gun or electromagnetic accelerator. The compression chamber can be formed in a liquid material such liquid metal. For example, in some implementations, at least a portion of the compression chamber is formed by the flow of a liquid metal as described herein with reference to FIG. 1. At block 108, a magnetized plasma is accelerated toward the liquid metal chamber. For example, the magnetized plasma may comprise a compact torus (e.g., a spheromak or FRC). The magnetized plasma may be accelerated using the plasma torus accelerator 34 in some embodiments. In some such embodiments, the magnetized plasma is generated and accelerated after the projectile has begun its acceleration toward the compression chamber, because the speed of the magnetized plasma can be much higher than the speed of the projectile. At block 112, impact of the projectile on the liquid metal (when the plasma is in the compression chamber) compresses the magnetized plasma in the compression chamber. The plasma can be heated during the compression. The projectile can break up and can melt into the liquid metal. At optional block 116, a portion of the liquid metal is recycled and used to form one or more new projectiles. For example, the liquid metal recirculation system and projectile factory 37 described with reference to FIG. 1 may be used for the recycling. The new projectiles can be used at block 104 to provide a pulsed system for plasma compression.

Embodiments of the above-described system and method are suited for applications in the study of high energy density plasma including, for example, applications involving the laboratory study of astrophysical phenomena or nuclear weapons. Certain embodiments of the above-described system and method can be used to compress a plasma that comprises a fusionable material sufficiently that fusion reactions and useful neutron production can occur. The gas used to form the plasma may comprise a fusionable material. For example, the fusionable material may comprise one or more isotopes of light elements such as, e.g., isotopes of hydrogen (e.g., deuterium and/or tritium), isotopes of helium (e.g., helium-3), and/or isotopes of lithium (e.g., lithium-6 and/or lithium-7). Other fusionable materials can be used. Combinations of elements and isotopes can be used. Accordingly, certain embodiments of the system 10 may be configured to act as pulsed-operation high flux neutron generators or neutron sources. Neutrons produced by embodiments of the system 10 have a wide range of uses in research and industrial fields. For example, embodiments of the system 10 may be used for nuclear waste remediation and generation of medical nucleotides. Additionally, embodiments of the system 10 configured as a neutron source can also be used for materials research, either by testing the response of a material (as an external sample) to exposure of high flux neutrons, or by introducing the material sample into the compression region and subjecting the sample to extreme pressures, where the neutron flux may be used either as a diagnostic or as a means for transmuting the material while at high pressure. Embodiments of the system 10 configured as a neutron source can also be used for remote imaging of the internal structure of objects via neutron radiography and tomography, and may be advantageous for applications requiring a fast pulse (e.g., several microseconds) of neutrons with high luminosity.

For some large scale industrial applications it may be economical to run several plasma compression systems at the same facility, in which case some savings may accrue by having a single shared projectile casting facility that recycles liquid metal from more than one system, and then distributes the finished projectiles to the loading mechanisms at the breach of each accelerator. Some such embodiments may be advantageous in that a misfire in a single accelerator may not bring the entire facility cycle to a halt, because the remaining compression devices may continue operating.

ADDITIONAL EMBODIMENTS AND EXAMPLES

The systems and methods described herein may be embodied in a wide range of ways. For example, in one embodiment, a method for compressing a plasma is provided. The method includes (a) circulating a liquid metal through a vessel and directing the liquid metal through a nozzle to form a cavity, (b) generating and injecting a magnetized plasma torus into the liquid metal cavity, (c) accelerating a projectile, having substantially the same composition as the liquid metal, toward the cavity so that it impacts the magnetized plasma torus, whereby the plasma is heated and compressed, and the projectile disintegrates and melts into the liquid metal. The method may also include (d) directing a portion of the liquid metal to a projectile-forming apparatus wherein new projectiles are formed to be used in step (c). One or more steps of the method may be performed repeatedly. For example, in some embodiments, steps (a)-(c) are repeated at a rate ranging from about 0.1 Hz to about 10 Hz.

In some embodiments of the method, the cavity can be roughly conical in shape. In some embodiments, the liquid metal comprises a lead-lithium alloy. In some embodiments, the liquid metal comprises a lead-lithium alloy with about 17% atomic concentration of lithium. In some embodiments, the liquid metal comprises a lead-lithium alloy with an atomic concentration of lithium in a range from about 5% to 20%. In some embodiments, the liquid metal may be circulated through a heat exchanger for reducing the temperature of the liquid metal.

In some embodiments of the method, the plasma comprises a fusionable material. In some embodiments, the fusionable material comprises deuterium and/or tritium. In some embodiments, the deuterium and tritium are provided in a mixture of about 50% deuterium and about 50% tritium. In some embodiments of the method, compression of the plasma results in heating of the plasma and/or production of neutrons and/or other radiation.

An embodiment of a plasma compression system is provided. The system comprises a liquid metal recirculation subsystem that comprises a containment vessel and a circulation pump for directing the liquid metal through a nozzle to form a cavity within the vessel. The system also comprises a plasma formation and injection device for repeatedly forming a magnetized plasma torus and injecting it into the metal cavity. The system also comprises a linear accelerator for repeatedly directing projectiles, having substantially the same composition as the liquid metal, toward the cavity. The system also comprises a projectile-forming subsystem comprising projectile-shaped molds in which new projectiles are formed and then directed to the linear accelerator, wherein the molds are connected to at least periodically receive liquid metal, comprising melted projectiles, that are recirculated from the containment vessel.

An embodiment of a plasma compression device is provided. The device comprises a linear accelerator for firing a projectile at high speeds into a muzzle coupled to a vacuum pump for creating at least a partial vacuum inside the muzzle. The system also comprises a conical focusing plasma injector having coaxial tapered electrodes connected to a power supply circuit to provide an electrical current. The electrodes may form a cone tapering to a focusing region. The system also includes a magnetized coaxial plasma gun for injecting material for generating a magnetized compact torus (e.g., a spheromak), and the open end of gun muzzle can be seated inside the cone in conductive contact with the inner electrode. The system also includes a recirculating vessel suitable for containing metal fluid and having an opening for receiving the tapered cone of accelerator and a base region, and a heat exchange line connected between the base and conical opening regions with a recirculation pump to pump fluid from the base to the conical opening. The tapered electrodes of the accelerator are seated within the conical opening such that the outer electrode surface guides a convergent flow path for the pressurized metal fluid creating a focusing region within the tapered fluid walls that confines and further focuses the magnetized spheromak compact torus, which can be compressed to a maximum compression zone in the inner cavity of the vessel. When the recirculating vessel is filled with fluid metal and fusionable material is injected, a projectile is fired by the gun to intercept the magnetized plasma ring when it has traveled near the tapered fluid wall, and compresses the plasma within the fluid to an increased pressure, thereby imparting kinetic energy to the plasma to increase ion temperature.

An embodiment of a plasma compression system includes an accelerator for firing a projectile toward a magnetized plasma (e.g., a plasma torus) in a cavity in a solid metal or a liquid metal. The system also may include a plasma injector for generating the magnetized plasma and injecting the magnetized plasma into the cavity. In embodiments comprising a cavity in liquid metal, the system may include a vessel configured to contain the liquid metal and having a tapered nozzle to form the cavity by flow of the liquid metal. The magnetized plasma is injected into the cavity, and a projectile fired by the accelerator intercepts the plasma and compresses the plasma against the surface of the cavity, creating a high pressure impact event that compresses the magnetized plasma. The plasma compression may result in heating of the plasma. Impact of the projectile with the cavity can cause the projectile to disintegrate. In embodiments comprising a liquid metal cavity, the projectile may melt into the liquid metal. In some such embodiments, a portion of the liquid metal may be diverted to cast new projectiles that can be used to maintain a repetitive firing cycle with a substantially closed inventory of liquid metal.

While particular elements, embodiments and applications of the present disclosure have been shown and described, it will be understood, that the scope of the disclosure is not limited thereto, since modifications can be made by those skilled in the art without departing from the scope of the present disclosure, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and subcombinations are intended to fall within the scope of this disclosure. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the inventions described herein.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The example calculations, simulations, results, graphs, values, and parameters of the embodiments described herein are intended to illustrate and not to limit the disclosed embodiments. Other embodiments can be configured and/or operated differently than the illustrative examples described herein.

Accordingly, while certain example embodiments have been described, these embodiments have been presented by way of example only, and are not intended to limit the scope of the inventions disclosed herein. Thus, nothing in the foregoing description is intended to imply that any particular feature, element, component, characteristic, step, module, or block is necessary or indispensable. Indeed, the novel methods and systems described herein may be embodied in a variety of other forms; furthermore, various omissions, substitutions and changes in the form of the methods and systems described herein may be made without departing from the spirit of the inventions disclosed herein. The accompanying claims and their equivalents are intended to cover such forms or modifications as would fall within the scope and spirit of certain of the inventions disclosed herein.

What is claimed is:

1. An apparatus for compressing plasma, the apparatus comprising:

a plasma injector configured to accelerate a compact toroid of plasma toward a cavity in a liquid metal;

a projectile accelerator configured to accelerate a projectile toward the cavity such that the projectile can impact a liquid surface of the cavity in the liquid metal, wherein a surface of the projectile and the liquid surface of the cavity define a compression chamber into which the compact toroid is confined; and a timing system configured to coordinate acceleration of the compact toroid and acceleration of the projectile such that the projectile confines the compact toroid in the compression chamber.

2. The apparatus of claim 1, wherein the projectile accelerator comprises a pneumatic gun.

3. The apparatus of claim 2, wherein the pneumatic gun comprises a valve system configured to at least partially evacuate a region in front of the projectile.

4. The apparatus of claim 3, wherein the valve system is configured to be synchronized such that a high pressure region is maintained behind the projectile and a low pressure region is maintained in front of the projectile.

5. The apparatus of claim 1, further comprising a liquid metal circulation system configured to provide a flow of the liquid metal, the flow configured to form the cavity in the liquid metal.

6. The apparatus of claim 5, further comprising a projectile recycling system configured to recycle a portion of the liquid metal to form at least one additional projectile.

7. The apparatus of claim 1, wherein the projectile recycling system comprises a loading mechanism configured to automatically load a recycled projectile into the projectile accelerator.

8. The apparatus of claim 1, wherein the surface of the projectile comprises a conical shape.

9. The apparatus of claim 8, wherein the conical shape is concave and has a cone angle in a range from about 20 degrees to about 80 degrees.

10. The apparatus of claim 1, wherein the compact toroid comprises a spheromak.

11. The apparatus of claim 1, wherein the plasma injector comprises at least one tapered electrode configured to compress the compact toroid during acceleration of the compact toroid.

12. The apparatus of claim 1, wherein the projectile accelerator comprises an inductive coil gun.

13. The apparatus of claim 1, wherein the timing system is configured to trigger formation of the compact toroid based at least in part on a position of the projectile relative to the cavity in the liquid metal.

14. The apparatus of claim 1, wherein the cavity comprises a concave shape.

15. The apparatus of claim 1, wherein the surface of the projectile comprises an elongated member extending along a longitudinal axis of the projectile.

16. The apparatus of claim 1, wherein the surface of the projectile comprises one or more coatings, at least one of the coatings comprising lithium or lithium-deuteride.

17. The apparatus of claim 1, wherein the liquid metal comprises a liquid phase of a metal material, and the projectile comprises a solid phase of the metal material.

* * * * *

UNITED STATES PATENT AND TRADEMARK OFFICE

CERTIFICATE OF CORRECTION

PATENT NO. : 8,891,719 B2
APPLICATION NO. : 12/845071
DATED : November 18, 2014
INVENTOR(S) : Stephen James Howard et al.

It is certified that error appears in the above-identified patent and that said Letters Patent is hereby corrected as shown below:

In the Specification

In column 8 at line 40, change "$P_{equ}P_{push}V_{gun}/V_{tank}$" to -- $\mathbf{P_{equ} = P_{push}\,V_{gun}/V_{tank}}$ --.

Signed and Sealed this
Thirtieth Day of June, 2015

Michelle K. Lee

Michelle K. Lee
*Director of the United States Patent and Trademark Office*